US011813842B2

(12) United States Patent
Takayama et al.

(10) Patent No.: US 11,813,842 B2
(45) Date of Patent: Nov. 14, 2023

(54) PRINTING APPARATUS

(71) Applicant: Brother Kogyo Kabushiki Kaisha, Nagoya (JP)

(72) Inventors: Haruhisa Takayama, Nagoya (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 58 days.

(21) Appl. No.: 17/705,703

(22) Filed: Mar. 28, 2022

(65) Prior Publication Data

US 2022/0305820 A1 Sep. 29, 2022

(30) Foreign Application Priority Data

Mar. 29, 2021 (JP) ..... 2021-054852

(51) Int. Cl.
*B41J 11/00* (2006.01)

(52) U.S. Cl.
CPC ..... *B41J 11/00212* (2021.01)

(58) Field of Classification Search
CPC ..... B41J 11/00212; B41J 11/00214; B41J 11/00216; B41J 11/00218
See application file for complete search history.

(56) References Cited

U.S. PATENT DOCUMENTS

2015/0124017 A1* 5/2015 Aoyama ..... B41J 11/00214 347/16
2017/0151810 A1 6/2017 Kamibayashi et al.

FOREIGN PATENT DOCUMENTS

| | | | |
|---|---|---|---|
| JP | 2006-110843 | A | 4/2006 |
| JP | 2010-005934 | A | 1/2010 |
| JP | 2015-058670 | A | 3/2015 |
| JP | 2015-066836 | A | 4/2015 |
| JP | 2015-085648 | A | 5/2015 |
| JP | 2017-105179 | A | 6/2017 |
| JP | 2018-192761 | A | 12/2018 |

* cited by examiner

*Primary Examiner* — Bradley W Thies
(74) *Attorney, Agent, or Firm* — Banner & Witcoff, Ltd.

(57) ABSTRACT

A printing apparatus includes a head which discharges liquid onto a printing medium; and a light irradiation unit which is aligned with the head in a first direction and which irradiates the liquid on the printing medium with light. The light irradiation unit has light source arrays arranged in the first direction, each of the light source arrays includes light sources aligned in a second direction, and the light source arrays include a first light source array which is disposed most closely to the head in the first direction. The light, which is radiated by each of the light sources included in the first light source array, has an intensity that is smaller than an intensity of the light which is radiated by each of the light sources included in the light source arrays different from the first light source array.

9 Claims, 15 Drawing Sheets

PRINTING APPARATUS

CROSS REFERENCE TO RELATED APPLICATIONS

The present application claims priority from Japanese Patent Application No. 2021-054852, filed on Mar. 29, 2021, the disclosure of which is incorporated herein by reference in its entirety.

BACKGROUND

The present teaching relates to a printing apparatus.

Conventionally, a printing apparatus provided with a head and a light-emitting element is known. The head can discharge liquid to a printing medium, and the light-emitting element can irradiate the liquid discharged to the printing medium with light.

SUMMARY

In the case of the printing apparatus described above, the liquid is discharged from the head, and the liquid is landed on the printing medium. Then, an image is printed on the printing medium by irradiating the printing medium with the light radiated from the light-emitting element so that the liquid is fixed to the printing medium. In the printing apparatus as described above, for example, when the printing medium has a three-dimensional shape, spacing distance between the light-emitting element and the printing medium changes depending on projections and recesses thereof. On this account, the time, which elapses until the liquid on the printing medium is irradiated with the light after the liquid is landed on the printing medium, changes. As a result, it is feared that the appearance of the liquid cured by the light may become nonuniform, and the deterioration of the quality of the image may be caused.

Taking the foregoing circumstances into consideration, an object of the present teaching is to provide a printing apparatus which makes it possible to suppress the deterioration of the printing image quality which would be otherwise caused by the shape of the printing medium.

According to a first aspect of the present teaching, there is provided a printing apparatus including: a head configured to discharge liquid onto a printing medium; and a light irradiation unit aligned with the head in a first direction and configured to irradiate the liquid on the printing medium with light, wherein the light irradiation unit has a plurality of light source arrays arranged in the first direction, each of the light source arrays includes a plurality of light sources aligned in a second direction intersecting with the first direction, the light source arrays include a first light source array disposed most closely to the head in the first direction, and the light, which is radiated by each of the light sources included in the first light source array, has an intensity that is smaller than an intensity of the light which is radiated by each of the light sources included in the light source arrays different from the first light source array.

According to a second aspect of the present teaching, there is provided a printing apparatus including: a head configured to discharge liquid onto a printing medium; a light irradiation unit aligned with the head in a first direction and configured to irradiate the liquid on the printing medium with light; and a controller, wherein the light irradiation unit has a plurality of light source arrays arranged in the first direction, each of the light source arrays includes a plurality of light sources aligned in a second direction intersecting with the first direction, the light source arrays include a proximity light source array disposed most closely to the head in the first direction, each of the light sources included in the proximity light source array is arranged to radiate the light having an optical axis, the optical axis extending to approach the head in the first direction as the optical axis proceeds from the light source in a third direction which intersects with the first direction and the second direction, and the controller is configured to: turn OFF the light sources included in the proximity light source array in a case that a gap between the light irradiation unit and the printing medium is a first gap; and turn ON the light sources included in the proximity light source array in a case that the gap is a second gap which is smaller than the first gap.

According to a third aspect of the present teaching, there is provided a printing apparatus including: a head configured to discharge liquid onto a printing medium; a relative movement device configured to relatively move the printing medium and the head in a relative movement direction; a light irradiation unit including a first light irradiation unit having a light source for irradiating the liquid on the printing medium with light, and a second light irradiation unit which is arranged nearer to the head than the first light irradiation unit in the relative movement direction and which has a light source for irradiating the liquid on the printing medium with light; and a controller, wherein the controller is configured to: turn ON the first light irradiation unit and turn OFF the second light irradiation unit, in a case that a gap between the light irradiation unit and the printing medium is a first gap and turn ON the second light irradiation unit is and turn OFF the first light irradiation unit, in a case that the gap is a second gap which is smaller than the first gap.

According to the printing apparatus of the present teaching, it is possible to suppress the deterioration of the printing image quality which would be otherwise caused by the shape of the printing medium.

The foregoing object, the other objects, the feature, and the advantage of the present teaching will be clarified from the following detailed explanation of the preferred embodiments with reference to accompanying drawings.

DETAILED DESCRIPTION

Figure 1:
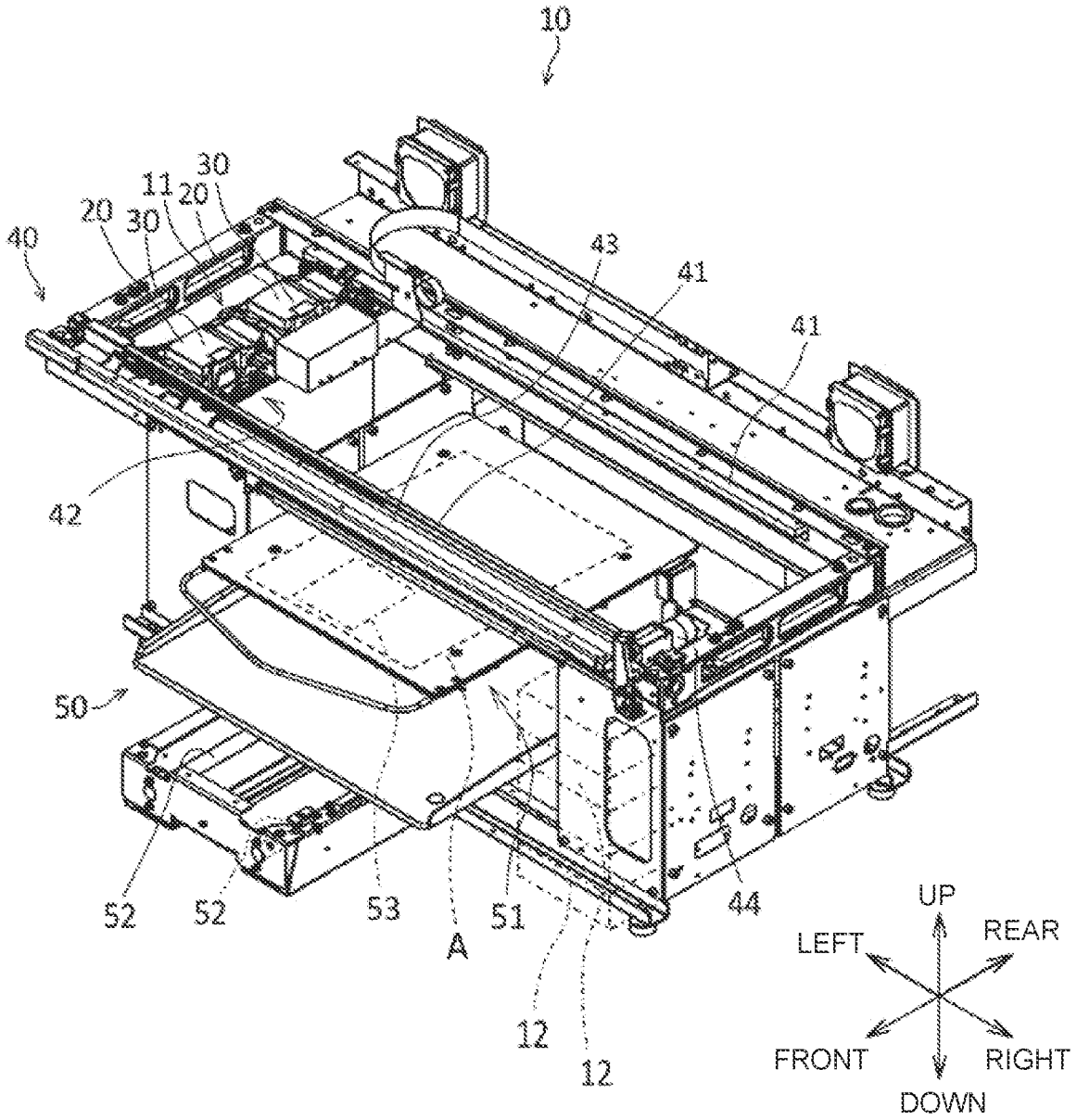
FIG. 1 is a perspective view of a printing apparatus.

An embodiment of the present teaching will be specifically explained below with reference to the drawings. Note that in the following description, the same or equivalent elements are designated by the same reference numerals throughout all of the drawings, any duplicate explanation of which will be omitted.

First Embodiment <Configuration of Printing Apparatus>

As depicted in FIG. 1, for example, a printing apparatus 10 according to a first embodiment of the present teaching is an ink-jet printer which prints an image by discharging a liquid from a head 20 to a printing medium A and irradiating the printing medium A with the light radiated from a light irradiation unit 30. The printing medium A is exemplified by a sheet including, for example, cloth or fabric and paper as well as a three-dimensional object including, for example, a ball and a mug. The liquid is a photocurable liquid. For example, the liquid is an ink which is curable by the light such as ultraviolet ray, infrared ray or the like. Further, for example, the printing apparatus 10 may be a 3D printer to prepare a formed object which is formed with the ink discharged from the head 20 and which is cured by the light radiated from the light irradiation unit 30. In this case, the preparing formed object is the printing medium A. Further, the printing apparatus 10 may print an image on the formed object by discharging the ink from the head 20 with respect to the prepared formed object and irradiating the ink with the light radiated from the light irradiation unit 30. In this case, the prepared formed object is the printing medium A.

Figure 2:
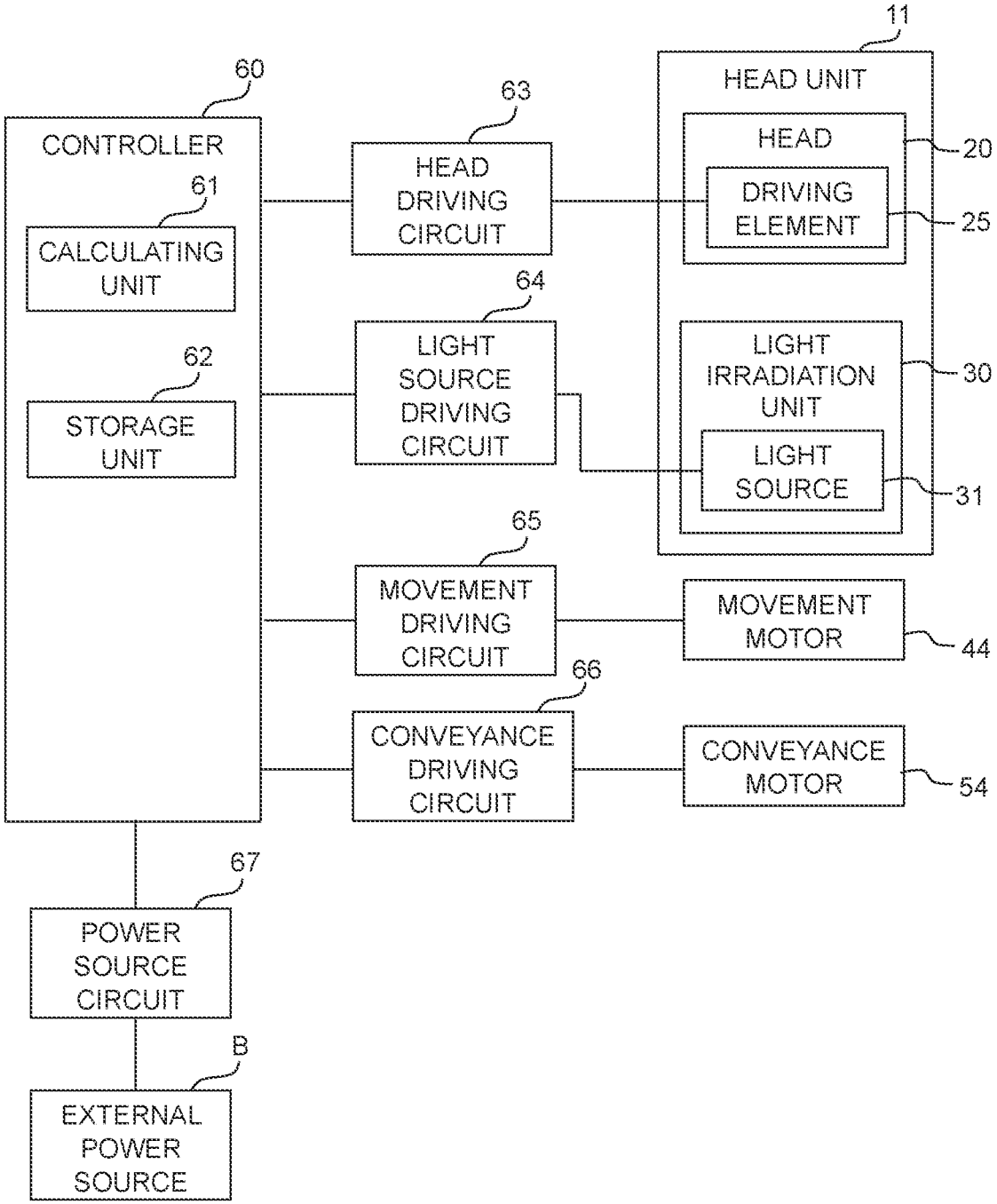
FIG. 2 is a functional block diagram illustrative of the configuration of the printing apparatus depicted in FIG. 1.

The printing apparatus 10 is provided with a head unit 11, a relative movement device 40, a conveying device 50, a tank 12, and a controller 60 (FIG. 2). Note that details of the controller 60 will be described later on. Further, the first direction, in which the head 20 and the light irradiation unit 30 are aligned, is referred to as "left-right direction". The second direction, which intersects with (for example, is orthogonal to) the first direction, is referred to as "front-rear direction". The direction, which intersects with (for example, is orthogonal to) the left-right direction and the front-rear direction, is referred to as "upward-downward direction". However, the arrangement of the printing apparatus 10 is not limited thereto.

The relative movement device 40 has a pair of movement rails 41, a carriage 42, a driving belt 43, and a movement motor 44. The relative movement device 40 moves the head unit 11 in the left-right direction. The pair of movement rails 41 are lengthy members which extend in the left-right direction. The pair of movement rails 41 are arranged in parallel to one another so that the head unit 11 is interposed therebetween in the front-rear direction. The carriage 42 carries the head unit 11. The carriage 42 is supported movably in the left-right direction along the movement rails 41. The driving belt 43 is an endless belt which extends along the movement rails 41 in the left-right direction. The driving belt 43 is connected to the carriage 42 and coupled to the movement motor 44 via a pulley. The movement motor 44 drives the driving belt 43, and thus the carriage 42 is reciprocatively moved in the left-right direction along the movement rails 41. Accordingly, the relative movement device 40 relatively moves the printing medium A and the head 20 and light irradiation unit 30 in the left-right direction.

The conveying device 50 has a stage 51, a conveyance rail 52, a stage support stand 53, and a conveyance motor 54 (FIG. 2). The printing medium A is placed on the upper surface of the stage 51. The stage 51 supports the printing medium A to thereby prescribe the gap in the upward-downward direction between the printing medium A and the head 20. The conveyance rail 52 extends in the front-rear direction. The stage support stand 53 is supported movably in the front-rear direction by the conveyance rail 52, for example, in a state in which the stage support stand 53 supports the stage 51. The stage support stand 53 is coupled to the conveyance motor 54. The conveyance motor 54 drives the stage support stand 53, and thus the stage support stand 53 moves the stage 51 in the front-rear direction.

The head unit 11 is provided with the head 20 and the light irradiation unit 30. The head unit 11 is arranged so that the lower surfaces of the head 20 and the light irradiation unit 30 are opposed to the upper surface of the stage 51. The tank 12 is a vessel or container for accommodating the liquid. The tank 12 is connected to the head 20 by means of a tube or the like to supply the liquid.

<Configuration of Head Unit>

Figure 3:
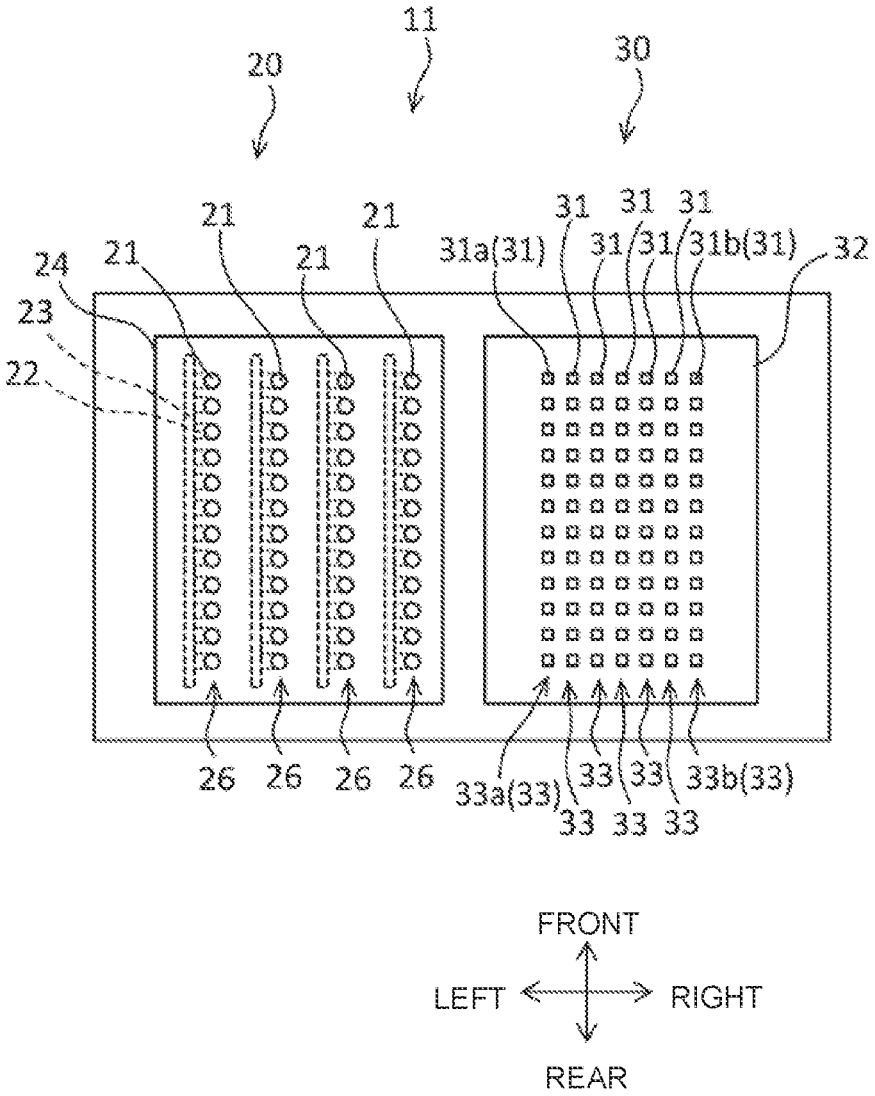
FIG. 3 is a schematic drawing of a head unit depicted in FIG. 1 as viewed from a lower position.
Figure 4:
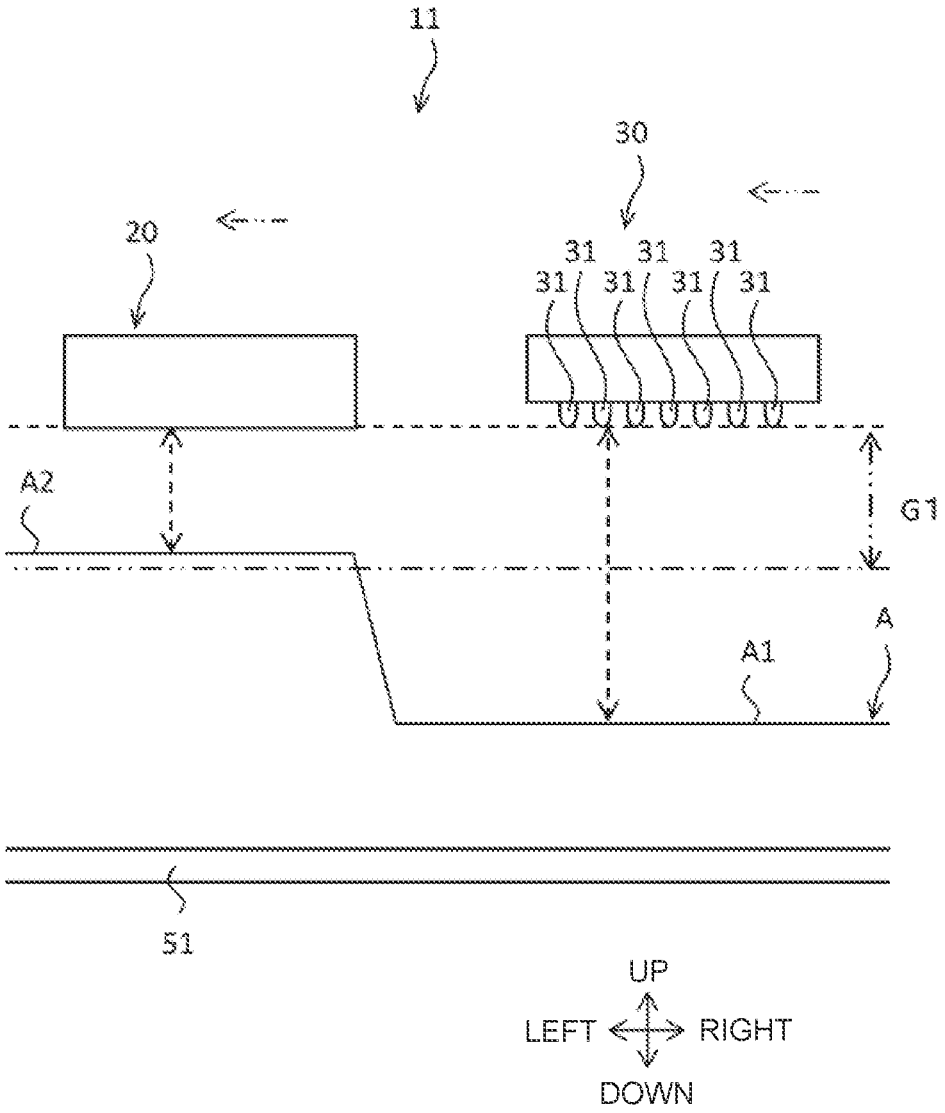
FIG. 4 is a schematic drawing of the head unit and a stage depicted in FIG. 1 as viewed from a front position.

As depicted in FIGS. 3 and 4, the head 20 has a plurality of nozzles 21, liquid flow passages, a flow passage forming member 24, and a plurality of driving elements 25 (FIG. 2). The plurality of nozzles 21 are mutually aligned at equal intervals in the front-rear direction to form nozzle arrays 26. The plurality of nozzle arrays 26 are mutually aligned at equal intervals in the left-right direction.

The flow passage forming member 24 has, for example, a rectangular parallelepiped shape. The plurality of nozzles 21 and the liquid flow passages are formed at the inside thereof. The plurality of nozzles 21 are open on the lower surface of the flow passage forming member 24. The liquid flow passages are connected to the tank 12 (FIG. 1) and the plurality of nozzles 21. The liquid flow passage has a plurality of common flow passages 23 and a plurality of individual flow passages 22. Each of the common flow passages 23 extends in the front-rear direction, which is branched into the plurality of individual flow passages 22. Each of the individual flow passages 22 has its upstream end which is connected to one common flow passage 23 and its downstream end which is connected to one nozzle 21. On this account, the liquid flows from the tank 12 to each of the common flow passages 23. The flow is divided to arrive at the plurality of individual flow passages 22 during the flow in the front-rear direction through each of the common flow passages 23, and the liquid is supplied to the plurality of nozzles 21.

The driving element 25 is, for example, a piezoelectric element, a heat generating element, or an electrostatic type actuator. The driving element 25 is provided corresponding to each of the individual flow passages 22. The driving element 25 is driven so that the volume of each of the individual flow passages 22 is varied. Accordingly, the pressure is applied to the liquid contained in each of the individual flow passages 22, and the liquid is discharged from the corresponding nozzle 21.

The light irradiation unit 30 is arranged upstream from the head 20 in the direction in which the head 20 is moved while discharging the liquid. In the unidirectional printing, the liquid is discharged, for example, when the head 20 is moved to the left side, while the liquid is not discharged when the head 20 is moved to the right side. In this case, the light irradiation unit 30 is arranged on the right side (upstream side) of the head 20 in the movement direction to move to the left side during the printing. The light irradiation unit 30 radiates the light onto the liquid on the printing medium A while being moved to follow the head 20 which discharges the liquid onto the priming medium A.

Note that when the printing apparatus 10 performs the bidirectional printing, a pair of light irradiation units 30 are arranged so that the head 20 is interposed therebetween in the left-right direction. The right light irradiation unit 30, which is included in the pair of light irradiation units 30, radiates the light onto the liquid on the printing medium A while being moved to the left side to follow the head 20 when the head 20 discharges the liquid onto the printing medium A while being moved to the left side. Further, the left light irradiation unit 30, which is included in the pair of light irradiation units 30, radiates the light onto the liquid on the printing medium A while being moved to the right side to follow the head 20 when the head 20 discharges the liquid onto the printing medium A while being moved to the right side.

The light irradiation unit 30 has a plurality of light sources 31 and a circuit board 32 on which the plurality of light sources 31 are carried. The circuit board 32 is composed of, for example, an insulating material, which has a rectangular flat plate shape. The circuit board 32 has the lower surface on which the plurality of light sources 31 are carried. Each of the light sources 31 is, for example, a light-emitting element such as LED or the like. Each of the light sources 31 is driven by the controller 60 to emit the light (for example, ultraviolet ray or infrared ray) to cure the liquid discharged from the plurality of nozzles 21.

The intensity of the light radiated by each of the light sources 31 resides in the radiant flux allowed to outgo per unit time from the unit area of the light source 31, which is, for example, the radiant exitance ($mW/cm^2$). On the other hand, the illuminance of the light on the printing medium A radiated from each of the light sources 31 resides in the radiant flux per unit area of the printing medium A of the light allowed to come per unit time from the light source 31, which is, for example, the irradiance ($mW/cm^2$). Note that the illuminance may be the integrated light amount obtained by multiplying the irradiance ($mW/cm^2$) by the light irradiation time (s). The integrated light amount is the light energy ($mJ/cm^2$) per unit area of the printing medium A of the light radiated from the light irradiation unit 30.

The plurality of light sources 31 form the plurality of light source arrays 33. Each of the light source arrays 33 is configured by the plurality of light sources 31 aligned in the front-rear direction. The plurality of (for example, seven) light source arrays 33 are aligned while providing spaces in the left-right direction, which include the first light source array 33*a* disposed most closely to the head 20. The first light source array 33*a* has the space with respect to the head 20 in the left-right direction, the space being smaller than those of the other light source arrays 33. In the following description, the plurality of light sources 31, which constitute the first light source array 33*a*, are referred to as "plurality of first light sources 31*a*". The intensity of the light radiated by the first light sources 31*a* is smaller than the intensity of the light radiated by each of the other light sources 31 other than the first light sources 31*a*.

The first light source 31*a* has the light-emitting element which radiates the light having the intensity smaller than the intensity of the light of each of the other light sources 31 for constructing the light source arrays 33 other than the first light source array 33*a*. That is, the light-emitting element of the first light source 31*a* has the maximum intensity of the light which is smaller than those of the light-emitting elements of the other light sources 31. For example, when the electric power, which is the same as that for the other light sources 31 is supplied, the light-emitting element 31*a* of the first light source 31*a* radiates the light having the intensity smaller than that of the light-emitting element of each of the other light sources 31.

<Configuration of Controller>

As depicted in FIG. 2, the controller 60 is connected to the driving element 25 via a head driving circuit 63 to control the driving of the driving element 25. The controller 60 is connected to the light source 31 via a light source driving circuit 64 to control the driving of the light source 31. The controller 60 is connected to the movement motor 44 via a movement driving circuit 65 to control the driving of the movement motor 44. The controller 60 is connected to the conveyance motor 54 via a conveyance driving circuit 66 to control the driving of the conveyance motor 54. Accordingly, the controller 60 controls, for example, the driving, the stop, and the rotation speed of each of the movement motor 44 and the conveyance motor 54.

The controller 60 is connected to an external power source B such as the commercial power source or the like via a power source circuit 67. The power source circuit 67 generates the output voltage from the DC voltage fed from the external power source B, and the power source circuit 67 supplies the electric power to the respective components including, for example, the driving element 25, the light source 31, the movement motor 44, and the conveyance motor 54 of the printing apparatus 10. The electric power is controlled by the controller 60. In this case, the controller 60 controls the power source circuit 67 so that the same electric power is mutually supplied to the first light sources 31*a* and the other light sources 31 of the light irradiation unit 30.

The controller 60 has a calculating unit 61 and a storage unit 62. The storage unit 62 is a memory which is accessible by the calculating unit 61. The memory is configured, for example, by RAM and ROM. RAM temporarily stores various data including, for example, the printing data. ROM stores programs in order to perform various data processings. Note that the controller 60 may be either a single controller 60 for performing the centralized control or a plurality of controllers 60 for performing the decentralized control. Further, the programs may be stored on any other storage medium other than the storage unit 62. Further, the programs may be stored on a single storage medium, or the programs may be stored on a plurality of storage media in a divided manner.

The calculating unit 61 is configured, for example, by a processor such as CPU or the like and an integrated circuit such as ASIC or the like. The calculating unit 61 controls the driving element 25, the light sources 31, the movement motor 44, and the conveyance motor 54 by executing the program stored in ROM so that the printing process is executed.

<Printing Process>

In the printing apparatus 10 as described above, the controller 60 acquires the printing data to execute the printing process on the basis of the printing data. The printing data includes the image data (for example, raster data) which represents an image to be printed on the printing medium A. The printing data may be stored in the storage unit 62, or the printing data may be acquired from any external apparatus including, for example, the network, the computer, and the storage medium.

The controller 60 controls the movement motor 44 to execute the movement action for moving the head unit 11 in the left-right direction. Further, the controller 60 controls the driving element 25 to execute the discharging action for discharging the liquid from the head 20. Further, the controller 60 controls the light source 31 to execute the light irradiation action for radiating the light from the light source 31. Further, the controller 60 controls the conveyance motor 54 to execute the conveyance action for conveying the printing medium A frontwardly. Then, the printing apparatus 10 progressively advances the printing process by alternately repeating the scanning and the conveyance action, the scanning including the movement action, the discharging action, and the light irradiation action.

In the scanning, as depicted in FIG. 4, the liquid is discharged from the head 20, while allowing the head 20 to move to the left side. Accordingly, the liquid is landed on the printing medium A on the stage 51 opposed to the lower surface of the head 20. Further, the light is radiated from the light sources 31, while allowing the light irradiation unit 30 to move to the left side to follow the head 20. Accordingly, the liquid, which is disposed on the printing medium A opposed to the light sources 31, is irradiated with the light. The liquid is cured by the light, and the liquid is fixed to the printing medium A. Thus, the image is printed on the printing medium A by means of the liquid.

In the exemplary case depicted in FIG. 4, the gap between the printing medium A and the light irradiation unit 30 differs in the left-right direction. The gap has a first gap which is not less than a predetermined value G1 and a second gap which is less than the predetermined value G1. On this account, the printing medium A has a first gap area A1 which is an area of the first gap and a second gap area A2 which is an area of the second gap.

Figure 5A:
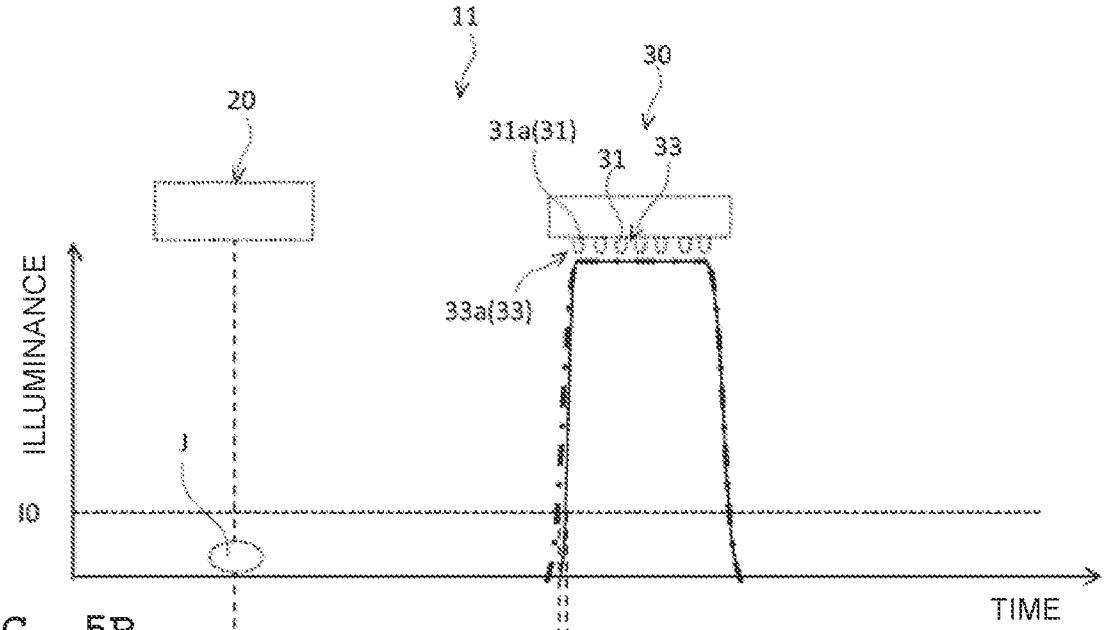
FIG. 5A is a graph illustrative of the time-dependent change of the illuminance of the light in a second gap area when the illuminance of the light coming from a first light source array is smaller than the illuminance of the light coming from the other light source arrays.
Figure 5B:
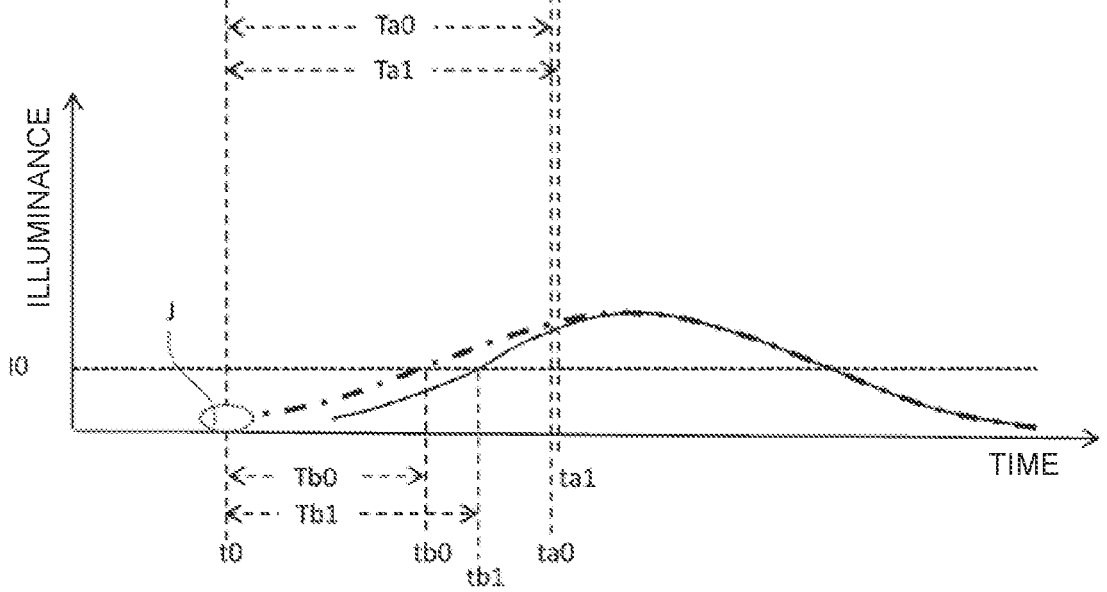
FIG. 5B is a graph illustrative of the time-dependent change of the illuminance of the light in a first gap area when the illuminance of the light coming from the first light source array is smaller than the illuminance of the light coming from the other light source arrays.

In this case, the irradiation range of the light coming from the light irradiation unit 30, which is provided in the first gap area A1 depicted in FIG. 5B, is wider than the irradiation range of the light coming from the light irradiation unit 30 which is provided in the second gap area. A2 depicted in FIG. 5A. On this account, for example, if the liquid J is cured by the light before the liquid J spreads on the printing medium A after the liquid is landed on the first gap area A1, the appearance of the cured matter becomes mat. On the other hand, for example, if the liquid J is cured by the light after the liquid J spreads on the printing medium A after the liquid J is landed on the second gap area A2, the appearance of the cured matter becomes gloss.

If the curing time of the liquid differs depending on the gap as described above, the printing image quality is deteriorated due to the nonuniformity of the appearance of the cured matter. On the other hand, in the case of the printing apparatus 10, the light, which is radiated from the first light source 31*a* of the first light source array 33*a* disposed most closely to the head 20 in the left-right direction and included in the plurality of light source arrays 33, has the intensity smaller than the intensity of the light which is radiated from the light source 31 of each of the other light source arrays 33 other than the first light source array 33*a* included in the plurality of light source arrays 33. Accordingly, the curing time difference, which is provided until the liquid J landed on the printing medium A is cured, can be decreased, and the deterioration of the image quality can be reduced.

Specifically, as depicted in FIG. 5A and FIG. 5B, when the light irradiation unit 30 radiates the light downwardly toward the printing medium A, the light spreads in the direction orthogonal to the upward-downward direction at positions separated downwardly farther from the light irradiation unit 30. The illuminance of the light (mW/cm$^2$), which is provided on the printing medium A, is increased at positions disposed nearer to the center of the light irradiation unit 30 in the direction orthogonal to the upward-downward direction, and the illuminance is decreased at positions separated farther from the center. The range, in which the illuminance is not less than a predetermined curing illuminance on the printing medium A, is designated as "light irradiation range". The predetermined curing illuminance is, for example, the illuminance I0 for curing the liquid J on the printing medium A.

The curing includes the permanent curing and the temporary curing. The temporary curing resides in such a state that the viscosity of the liquid is higher than that of the liquid in an uncured state provided immediately after the landing, but the liquid is not completely cured. In other words, the viscosity of the liquid is raised in this state to a viscosity at which the liquid does not flow on the printing medium A. Specifically, the liquid is in a gel state. The permanent curing resides in such a state that the liquid is completely cured. Specifically, the liquid does not adhere to the hand in this state even if the liquid is touched by the hand.

In FIG. 5A and FIG. 5B, the alternate long and short dash line indicates the illuminance on the printing medium A of the light radiated from the light irradiation unit 30 when the intensity of the light of the first light source 31*a* is equal to the intensity of the light of each of the other light sources 31. As depicted by the alternate long and short dash line, the smaller the gap is, the narrower the light irradiation range on the printing medium A is. On this account, the smaller the gap is, the longer the distance between the landing position of the liquid J on the printing medium A and the light irradiation range is. On this account, the curing time Ta0 of the liquid J (time which elapses until the illuminance of the light arrives at a predetermined curing illuminance I0 at a time ta0 after the liquid J is landed at a time t0) is longer than the curing time Tb0 of the liquid J (time which elapses until the illuminance of the light arrives at the predetermined curing illuminance I0 at a time tb0 after the liquid J is landed at the time t0).

In FIG. 5A and FIG. 5B, the solid line indicates the illuminance on the printing medium A of the light radiated from the light irradiation unit 30 when the intensity of the light of the first light source 31*a* is smaller than the intensity of the light of each of the other light sources 31. Owing to the low intensity of the light of the first light source 31*a*, the light irradiation range indicated by the solid line is narrower than the light irradiation range indicated by the alternate long and short dash line on the side of the head 20 with respect to the light irradiation unit 30. On this account, as depicted by the solid line in FIG. 5A, in the second gap, the curing time Ta1 of the liquid J, which elapses until the illuminance of the light arrives at the predetermined curing illuminance I0 at a time ta1 after the liquid J is landed at the time t0, is longer than the curing time Ta0 indicated by the alternate long and short dash line. Further, as depicted by the solid line in FIG. 5B, in the first gap, the curing time Tb1 of the liquid J, which elapses until the illuminance of the light arrives at the predetermined curing illuminance I0 at a time tb1 after the liquid J is landed at the time t0, is longer than the curing time Tb0 indicated by the alternate long and short dash line.

In this case, the larger the gap is, the larger the amount of decrease of the light irradiation range is. On this account, the difference between the curing time Tb1 and the curing time Tb0 in relation to the first gap is larger than the difference between the curing time Ta1 and the curing time Ta0 in relation to the second gap. Therefore, the curing time Tb1 coincides with or approaches the curing time Ta1. It is possible to reduce the nonuniformity of the appearance of the cured matter of the liquid J, and it is possible to suppress the deterioration of the printing image quality which would be otherwise caused by the shape of the printing medium A.

First Modified Embodiment

In a first modified embodiment, the controller 60 as described in the first embodiment controls the first light sources 31*a* so that the intensity of the light of each of the first light sources 31*a* is decreased when the gap between the light irradiation unit 30 and the printing medium A is the first gap as compared with when the gap is the second gap which is smaller than the first gap.

Specifically, the first light source 31*a* has a light-emitting element in which the intensity of the light allowed to outgo can be changed depending on the supplied electric power. When the electric power, which is the same as those for the light-emitting elements of the other light sources 31, is supplied, the light-emitting element of the first light source 31*a* radiates the light having the intensity which is the same as those of the other light sources 31. Further, when the electric power, which is smaller than those for the light-emitting elements of the other light sources 31, is supplied, the light-emitting element of the first light source 31*a* radiates the light having the intensity which is smaller than those of the other light sources 31. For example, this control includes the control in which the intensity of the light is lowered in accordance with the PWM control.

In this case, in the scanning during the printing process, the controller 60 obtains the gap information which represents the gap between the printing medium A and the light irradiation unit 30 on the basis of, for example, the measurement with a sensor provided for the printing apparatus 10 or the specification to represent the shape of the printing medium A. Then, the controller 60 acquires, on the basis of the gap information, the first gap area A1 in which the gap with respect to the light irradiation unit 30 is the first gap and the second gap area A2 in which the space with respect to the light irradiation unit 30 is the second gap in relation to the printing medium A.

Then, in the first gap, the controller 60 lowers the intensity of the light of the first light source 31*a* as compared with the intensities of the light of the other light sources 31. Accordingly, as depicted by the solid line in FIG. 5B, the light, which comes from the light irradiation unit 30 in the first gap area A1 of the printing medium A, has the illuminance which arrives at the predetermined curing illuminance I0 at the time tb1. The liquid J on the first gap area A1 is cured in the curing time Tb1.

On the other hand, for example, in the second gap, the controller 60 allows the intensity of the light of the first light source 31*a* to be the intensity of the light which is the same as those of the other light sources 31. Accordingly, as depicted by the alternate long and short dash line in FIG. 5A, the light, which comes from the light irradiation unit 30 in the second gap area A2 of the printing medium A, has the intensity which arrives at the predetermined curing illuminance I0 at the time ta0. The liquid J on the second gap area A2 is cured in the curing time Ta0.

Accordingly, the curing time Tb1 coincides with or approaches the curing time Ta0. It is possible to reduce the nonuniformity of the appearance of the cured matter of the liquid J, and it is possible to suppress the deterioration of the printing image quality which would be otherwise caused by the shape of the printing medium A. Note that in the second gap, the controller 60 may lower the intensity of the light of the first light source 31*a* as compared with those of the other light sources 31. In this case, as depicted by the solid line in FIG. 5A, the light on the second gap area A2 is cured in the curing time Ta1. Accordingly, the curing time Tb1 coincides with or approaches the curing time Ta1. It is possible to reduce the nonuniformity of the appearance of the cured matter of the liquid J, and it is possible to suppress the deterioration of the printing image quality which would be otherwise caused by the shape of the printing medium A.

Second Modified Embodiment

In a second modified embodiment, the controller 60 as described in the first embodiment turns ON the first light sources 31*a* when the gap between the light irradiation unit 30 and the printing medium A is the second gap, while the controller 60 turns OFF the first light sources 31*a* when the gap is the first gap.

Specifically, the electric power, which is the same as those for the other light sources 31, is supplied to the first light source 31*a* which radiates the light having the intensity equal to those of the other light sources 31. The controller 60 controls the power source circuit 67 to switch the turning ON and the turning OFF of the first light source 31*a* by changing the electric power supplied to the first light source 31*a* or opening/closing the switch between the first light source 31*a* and the external power source B. In other words, the controller 60 turns ON the first light source 31*a* by supplying the same electric power as those for the other light sources 31 to the first light source 31*a*, or the controller 60 turns OFF the first light source 31*a* by stopping the supply of the electric power to the first light source 31*a*.

Figure 6A:
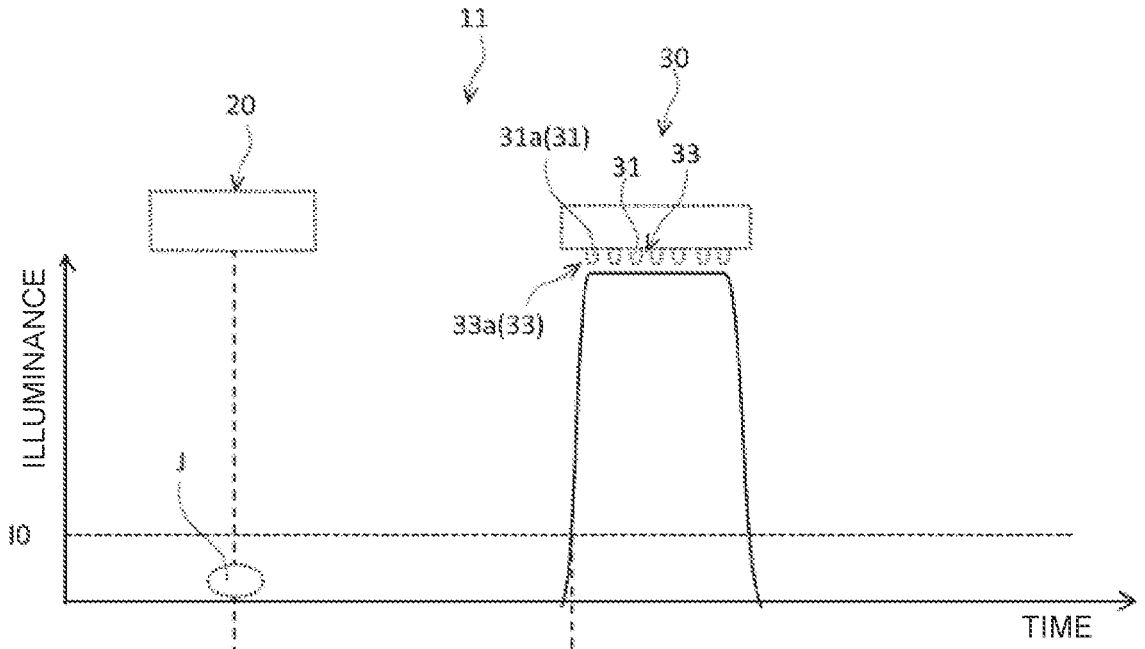
FIG. 6A is a graph illustrative of the time-dependent change of the illuminance of the light in a second gap area when the light sources of a first light source array are turned ON, and FIG. 6B is a graph illustrative of the time-dependent change of the illuminance of the light in a first gap area when the light sources of the first light source array are turned OFF.

In the scanning during the printing process, the controller 60 switches the turning ON and the turning OFF of the first light source 31*a* on the basis of the gap information. For example, in the second gap, the controller 60 turns ON all of the light sources 31 of the light irradiation unit 30 including the first light sources 31*a*. Accordingly, as depicted by the solid line in FIG. 6A, the light, which comes from the light irradiation unit 30 in the second gap area A2 of the printing medium A, has the illuminance which arrives at the predetermined curing illuminance I0 at the time ta0. The liquid J on the second gap area A2 is cured.

Figure 6B:
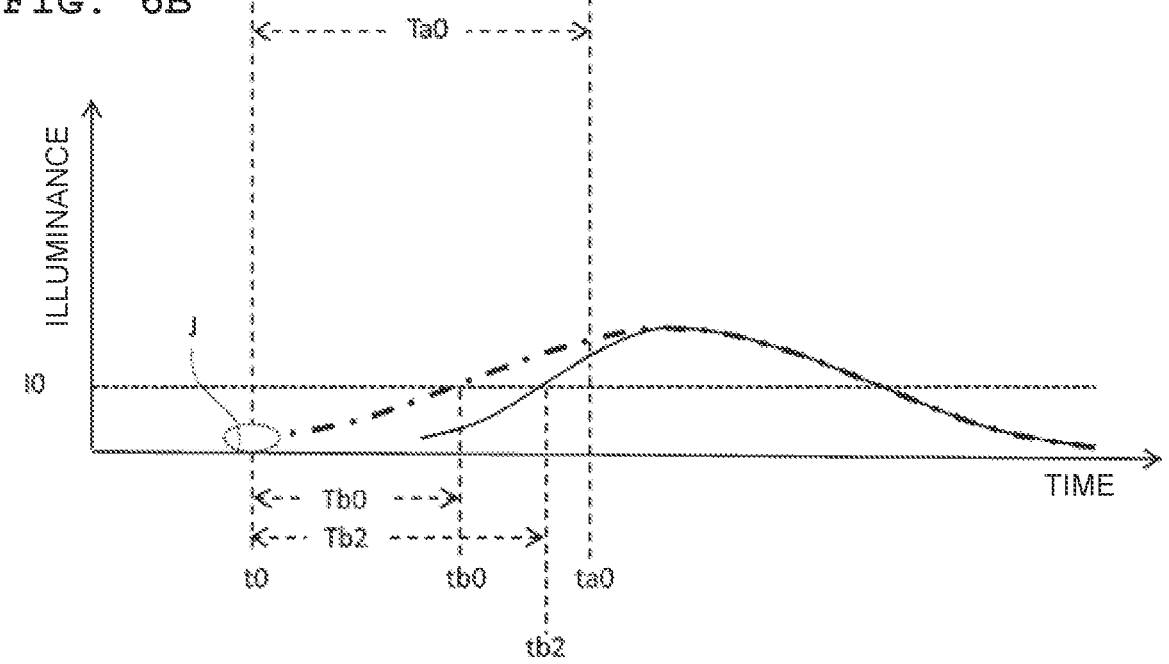

On the other hand, in the first gap, the controller 60 turns OFF the first light source 31*a*, and the controller 60 turns ON the other light sources 31 other than the first light source 31*a*. As depicted by the solid line in FIG. 6B, the light irradiation range in the first gap area of the printing medium A, which is provided when the first light source 31*a* is turned OFF, is narrower than the light irradiation range which is provided when the first light source 31*a* is turned ON as depicted by the alternate long and short dash line on the side of the head 20 deviated from the center of the light irradiation unit 30.

Accordingly, the curing time Tb2 of the liquid. J (time which elapses until the illuminance of the light arrives at the predetermined curing illuminance I0 at the time tb2 after the liquid J is landed at the time t0) is longer than the curing time Tb0 indicated by the alternate long and short dash line. On this account, the curing time Tb2 coincides with or approaches the curing time Ta0. It is possible to reduce the nonuniformity of the appearance of the cured matter of the liquid J, and it is possible to suppress the deterioration of the printing image quality which would be otherwise caused by the shape of the printing medium A.

Third Modified Embodiment

In a third modified embodiment, the plurality of light source arrays 33 as described in the first embodiment and the first and second modified embodiments include the second light source array 33*b*. The second light source array 33*b* is arranged while being separated from the first light source array 33*a* as compared with the center in the first direction of the plurality of light source arrays 33 in the first direction. The light, which is radiated by each of the light sources 31 of the second light source array 33*b*, has the intensity that is larger than the intensity of the light which is radiated by each of the light sources 31 of the light source arrays 33 other than the second light source array 33*b*.

Specifically, as depicted in FIG. 3, the space in the left-right direction between the second light source array 33*b* and the head 20 is larger than the space in the left-right direction between the center of the plurality of light source arrays 33 and the head 20. For example, the second light source array 33*b*, which is included in the plurality of light source arrays 33, is farthest from the head 20 in the left-right direction. In the following description, the plurality of light sources 31, which constitute the second light source array 33*b*, are referred to as "plurality of second light sources 31*b*". The light, which is radiated by the second light source 31*b*, has the intensity that is larger than the intensity of the light which is radiated by each of the other light sources 31 other than the second light source 31*b*. The second light source 31*b* has a light-emitting element which radiates the light having the intensity larger than those of the other light sources 31 when the electric power, which is the same as those for the other light sources 31, is supplied.

Figure 7A:
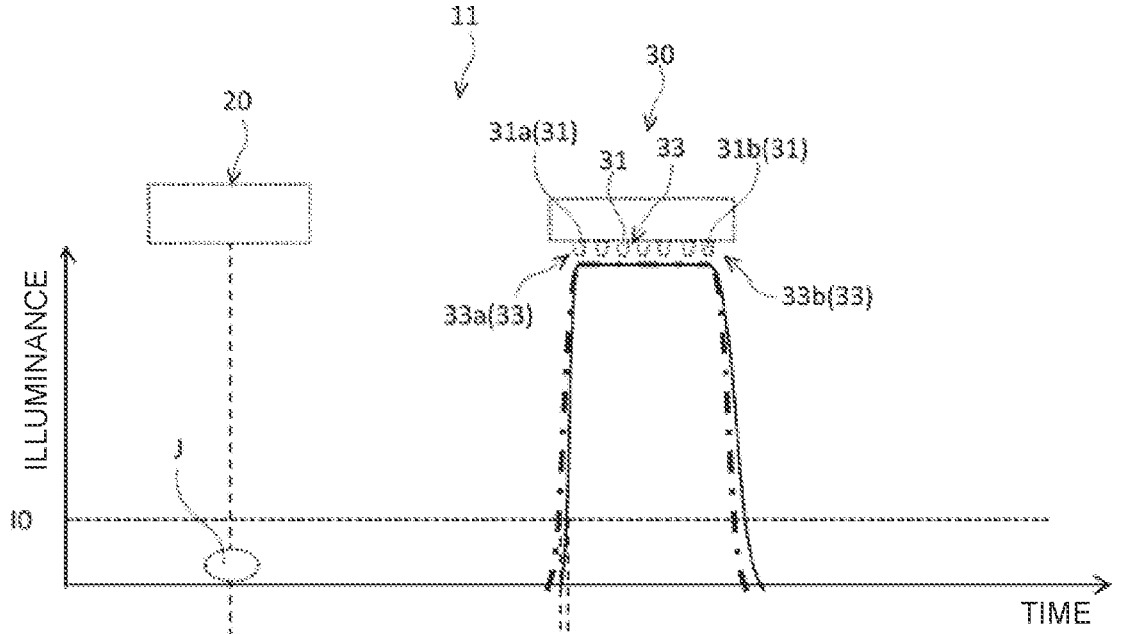
FIG. 7A is a graph illustrative of the time-dependent change of the illuminance in a second gap area when the illuminance of the light coming from a first light source array is smaller than the illuminance of the light coming from the other light source arrays and the illuminance of the light coming from a second light source array is larger than the illuminance of the light coming from the other light source arrays.
Figure 7B:
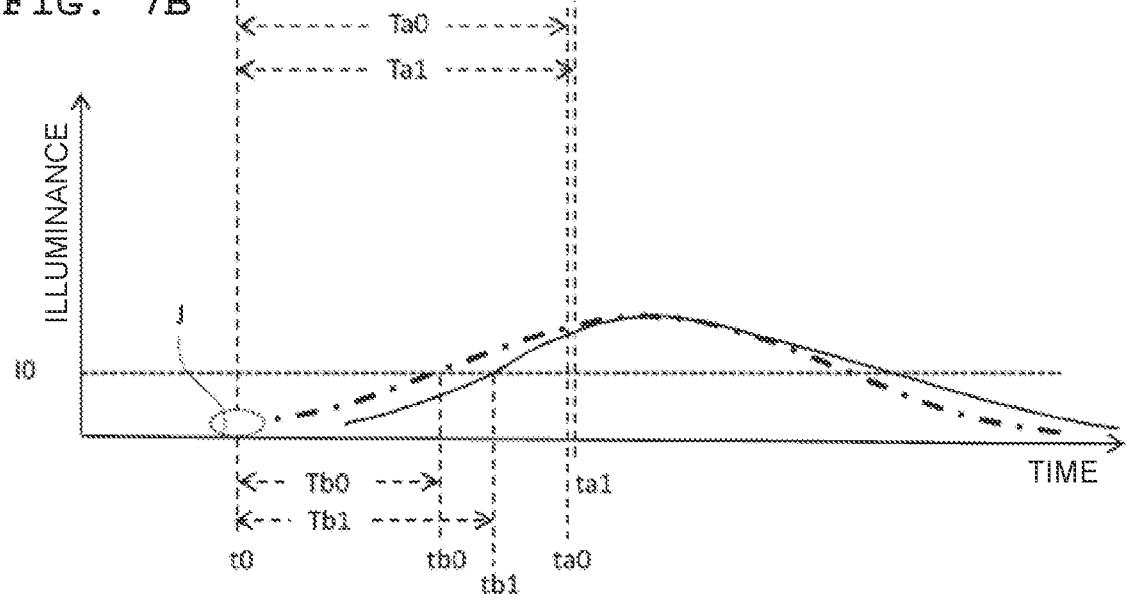
FIG. 7B is a graph illustrative of the time-dependent change of the illuminance in a first gap area when the illuminance of the light coming from the first light source array is smaller than the illuminance of the light coming from the other light source arrays and the illuminance of the light coming from the second light source array is larger than the illuminance of the light coming from the other light source arrays.

For example, in FIG. 7A and FIG. 7B, the alternate long and short dash line represents the illuminance of the light on the printing medium A when the intensities of the light of the first light source 31*a* and the second light source 31*b* are equal to the intensities of the light of the other light sources 31. The solid line represents the illuminance of the light on the printing medium A when the intensity of the light of the first light source 31*a* is smaller than the intensity of the light of each of the other light sources 31, and the intensity of the light of the second light source is larger than the intensity of the light of each of the other light sources 31. Owing to the intensity of the light of the first light source 31*a* which is lower than those of the other light sources 31, the illuminance indicated by the solid line is lowered as compared with the illuminance indicated by the alternate long and short dash line on the side of the head 20 deviated from the center of the light irradiation unit 30. On the other hand, the intensity of the light of the second light source 31*b* is higher than those of the other light sources 31. Therefore, the illuminance indicated by the solid line is increased as compared with the illuminance indicated by the alternate long and short dash line on the side opposite to the side of the head 20 deviated from the center of the light irradiation unit 30.

On this account, for example, as, depicted by the solid line in FIG. 7A, in the second gap, the liquid J is temporarily cured in the curing time Ta1, and then the liquid J can be sufficiently cured by receiving the light having the illuminance higher than the illuminance depicted by the alternate long and short dash line, from the second light source 31*b*. Further, as depicted by the solid line in FIG. 7B, in the first gap, the liquid J is temporarily cured in the curing time Tb1, and then the liquid J can be sufficiently cured by receiving the light having the illuminance higher than the illuminance depicted by the alternate long and short dash line, from the second light source 31*b*.

In this way, the second light source array 33*b* is arranged while being separated from the first light source array 33*a* as compared with the center in the left-right direction of the plurality of light source arrays 33. Thus, it is possible to reduce the spread of the light irradiation range toward the side of the head 20, and it is possible to reduce the nonuniformity of the appearance of the cured matter of the liquid J. Further, even when the illuminance of the light coming from the first light source array 33*a* is low, the liquid J is sufficiently cured owing to the high illuminance of the light coming from the second light source array 33*b*. Therefore, it is possible to suppress the deterioration of the printing quality which would be otherwise caused by the uncuring of the liquid J.

Fourth Modified Embodiment

In a fourth modified embodiment, the controller 60 as described in the third modified embodiment controls the second light sources 31*b* so that the intensity of the light of the second light source 31*b* is increased when the gap between the light irradiation unit 30 and the printing medium A is the first gap as compared with when the gap is the second gap which is smaller than the first gap.

Specifically, the second light source 31*b* has a light-emitting element in which the intensity of the light can be changed depending on the supplied electric power. In this case, the controller 60 controls the power source circuit 67 so that the electric power, which is larger than the electric power for the other light sources 31 of the light irradiation unit 30, is supplied to the second light source 31*b*, and thus the intensity of the light radiated by the second light source 31*b* is made larger than the intensity of the light radiated by each of the other light sources 31. Further, the controller 60 controls the power source circuit 67 so that the electric power, which is the same as the electric power for the other light sources 31 other than the second light source 31*b*, is supplied to the second light source 31*b*, and thus the intensity of the light radiated by the second light source 31*b* is made identical with the intensity of the light radiated by each of the other light sources 31.

Figure 8A:
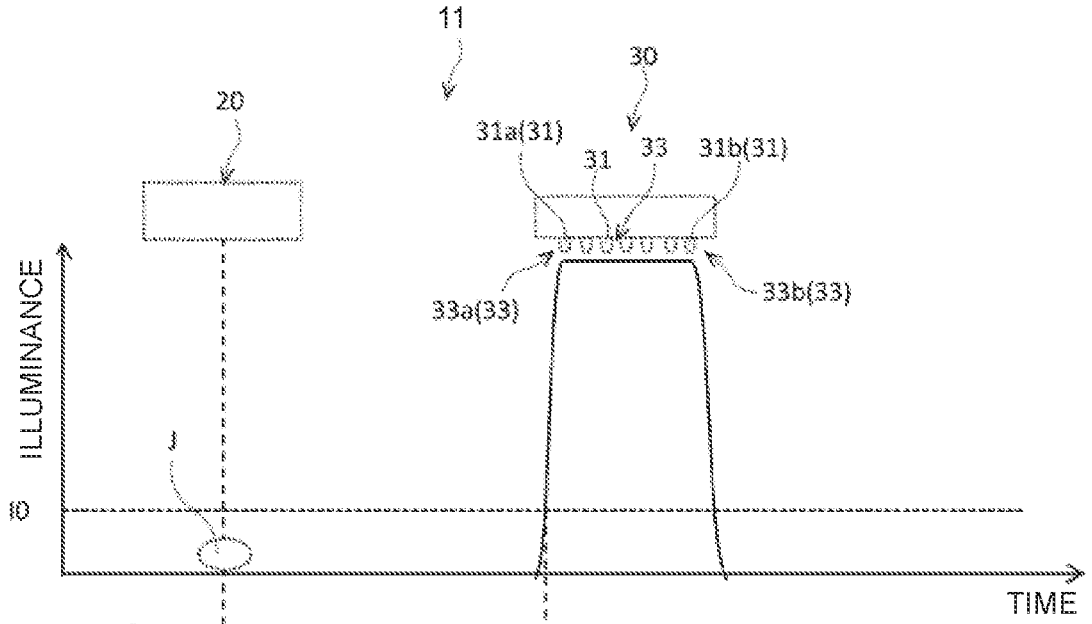
FIG. 8A is a graph illustrative of the time-dependent change of the illuminance in a second gap area when the light sources of a first light source array are turned ON and the illuminance of the light coming from a second light source array is the same as the illuminance of the light coming from the other light source arrays and FIG. 8B is a graph illustrative of the time-dependent change of the illuminance in a first gap area when the light sources of the first light source array are turned OFF and the illuminance of the light coming from the second light source array is larger than the illuminance of the light coning from the other light source arrays.

For example, as in the second modified embodiment, the controller 60 controls the power source circuit 67 to switch the turning ON and the turning OFF of the first light source 31*a*. In this case, as depicted in FIG. 8A, in the second gap, the controller 60 turns ON the first light source 31*a*, and the electric power, which is the same as the electric power for the other light sources 31, is supplied to the second light source 31*b*. Accordingly, all of the light sources 31 of the light irradiation unit 30 are turned ON, and they mutually radiate the light having the same intensity. Therefore, the light, which comes from the light irradiation unit 30 on the printing medium A, has the illuminance which arrives at the predetermined curing illuminance I0 at the time ta0. The liquid J on the printing medium A is cured in the curing time Ta0.

Figure 8B:
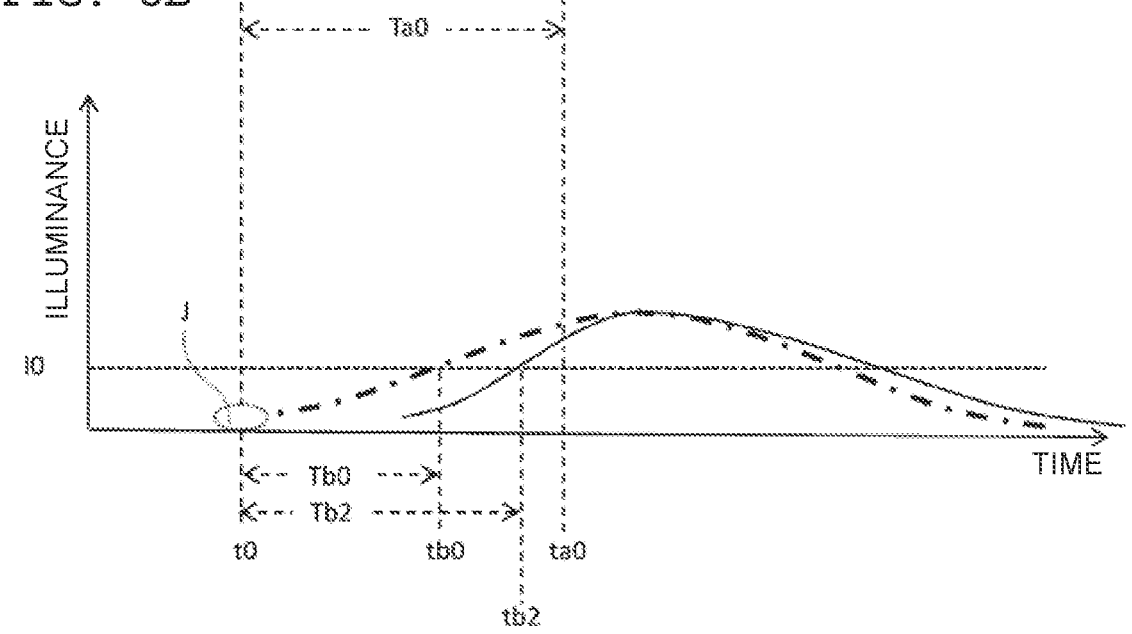

On the other hand, in the first gap, the controller 60 turns OFF the first light source 31*a*, the controller 60 turns ON the other light sources 31 other than the first light source 31*a*, and the electric power, which is larger than the electric power for the other light sources 31, is supplied to the second light source 31*b*. Accordingly, the second light source 31*b* radiates the light having the intensity which is higher than the intensity of each of the other light sources 31. On this account, as depicted by the solid line in FIG. 8B, the light, which comes from the light irradiation unit 30 on the printing medium A, has the illuminance which is lowered as compared with the illuminance depicted by the alternate long and short dash line provided when the first light source 31*a* is turned ON on the side of the head 20 deviated from the center of the light irradiation unit 30 and which is increased as compared with the illuminance depicted by the alternate long and short dash line on the side opposite to the side of the head 20 deviated from the center of the light irradiation unit 30. Accordingly, for example, the liquid J is temporarily cured in the curing time Tb2, and then the liquid J can be sufficiently cured by receiving the light having the high illuminance.

In this way, the second light source array 33*b* is arranged apart from the first light source array 33*a* as compared with the center in the left-right direction of the plurality of light source arrays 33. Thus, it is possible to reduce the spread of the light irradiation range to the side of the head 20, and it is possible to reduce the nonuniformity of the appearance of the cured matter of the liquid J. Further, even when the first light source array 33*a* is turned OFF, the liquid J is sufficiently cured owing to the high intensity of the light coming from the second light source array 33*b*. Therefore, it is possible to suppress the deterioration of the printing, quality which would be otherwise caused by the uncuring of the liquid J.

Second Embodiment

In a printing apparatus 10 according to a second embodiment, the head 20 and the light irradiation unit 30 are aligned in the first direction. The light irradiation unit 30 has a plurality of light source arrays 33 which are aligned in the first direction. Each of the light source arrays 33 is configured by a plurality of light sources 31 which are aligned in a second direction intersecting with a first direction. The proximity light source array 33*c*, which is included in the plurality of light source arrays 33 and which is disposed closest to the head 20 in the first direction, radiates the light having an optical axis 34*c*. The optical axis 34*c* of the proximity light source 31*c* is inclined to approach the head 20 in the first direction as the optical axis 34*c* proceeds from the proximity light source 31*c* in a third direction intersecting with the first direction and the second direction. The controller 60 turns OFF the proximity light source 31*c* when the gap between the light irradiation unit 30 and the printing medium A is the first gap, while the controller 60 turns ON the proximity light source 31*c* when the gap is the second gap which is smaller than the first gap.

Figure 9:
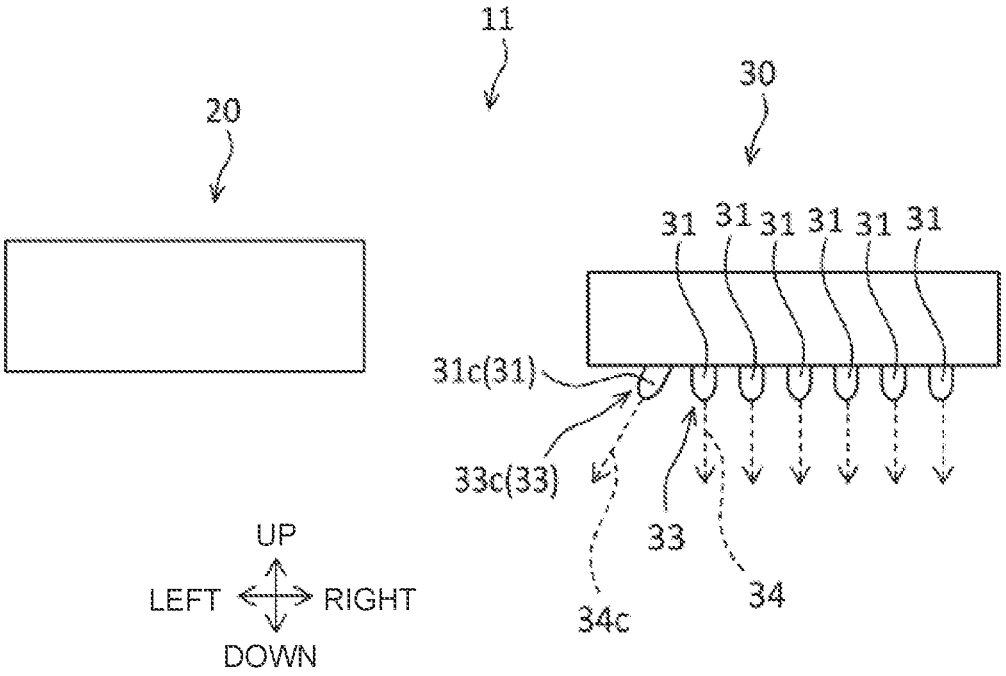
FIG. 9 is a schematic drawing of a head unit as viewed from a front position, the head unit being arranged so that a proximity light source radiates the light having an optical axis, the optical axis extending to approach a head in a first direction as the optical axis proceeds from the proximity light source in a third direction intersecting with the first direction and a second direction.

Specifically, as depicted in FIG. 9, the proximity light source array 33*c*, which is included in the plurality of light source arrays 33 of the light irradiation unit 30, is disposed most closely to the head 20. As for the proximity light source array 33*c*, the space with respect to the head 20 in the left-right direction is smaller than the other light source arrays 33. The light, which is radiated from the proximity light source 31*c*, has the optical axis 34*c* that is inclined so that the space is more increased at more downward positions with respect to the optical axes 34 of the light radiated from the light sources 31 other than the proximity light source 31*c*. The optical axes 34 of the other light sources 31 are directed downwardly from the concerning light sources 31. Each of the optical axes 34, 34*c* resides in the direction in which the largest light amount is provided, of the light radiated from each of the light sources 31, 31*c*. Note that the intensity of the light of the proximity light source 31*c* may be either lower than the intensity of the light of each of the other light sources 31 or equal to the intensity of the light of each of the other light sources 31.

Figure 10A:
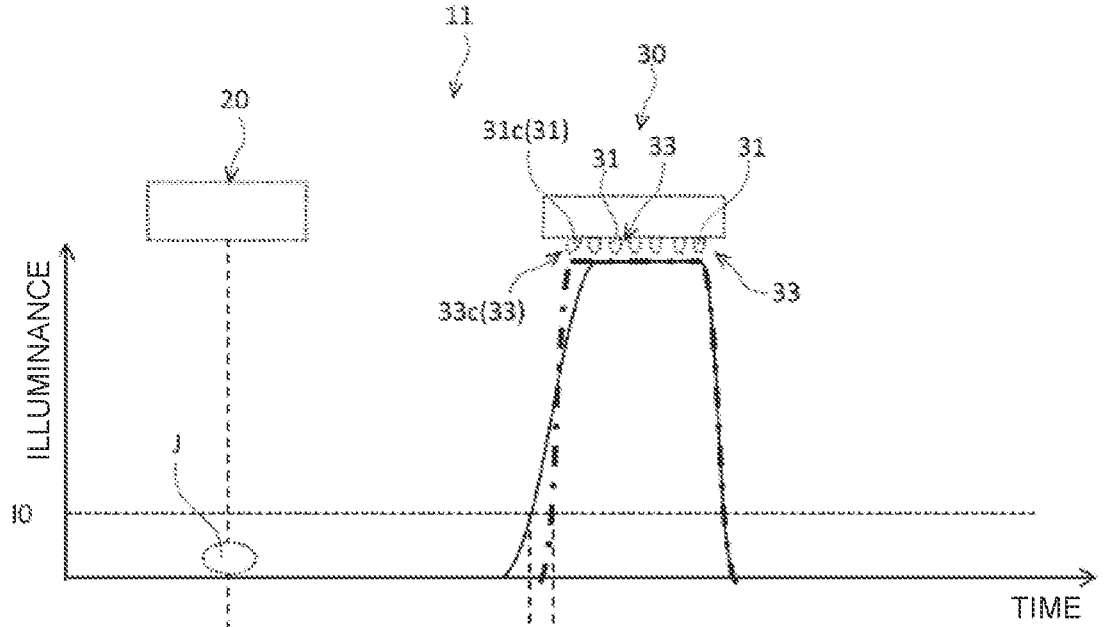
FIG. 10A is a graph illustrative of the time-dependent change of the illuminance in a second gap area when the light is radiated from a light irradiation unit in which the proximity light source depicted in FIG. 9 is turned ON, and FIG. 10B is a graph illustrative of the time-dependent change of the illuminance in a first gap area when the light is radiated from the light irradiation unit in which the proximity light source depicted in FIG. 9 is turned OFF.
Figure 10B:
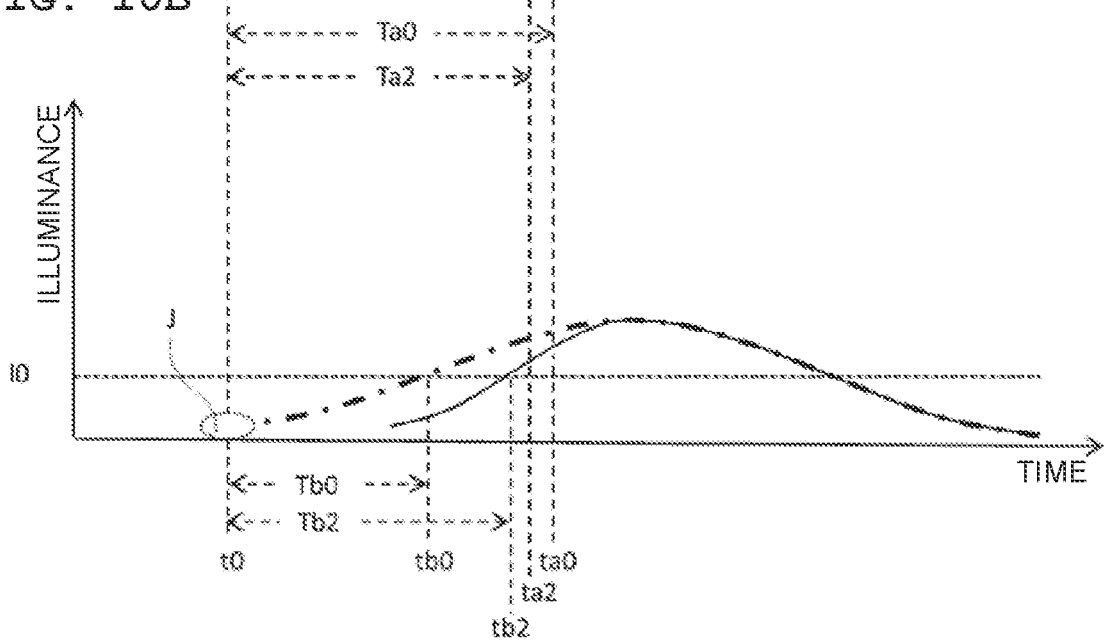

The controller 60 controls the power source circuit 67 to switch the turning ON and the turning OFF of the proximity light source 31*c*. Accordingly, as depicted in FIG. 10A and FIG. 10B, the illuminance on the printing medium A of the light radiated from the light irradiation unit 30 changes. Note that in FIG. 10A and FIG. 10B, the alternate long and short dash line indicates the illuminance on the printing medium A of the light radiated from the light irradiation unit 30 in which the light sources 31 including the proximity light sources 31*c* are turned ON when the optical axis 34*c* of the proximity light source 31*c* is parallel without being inclined with respect to the optical axes 34 of the other light sources 31.

As depicted by the solid line in FIG. 10A, in the second gap, the controller 60 turns ON all of the light sources 31 of the light irradiation unit 30 including the proximity light sources 31*c*. The light irradiation range in the second gap area, which is provided when the optical axis 34*c* of the proximity light source 31*c* is inclined, spreads on the side of the head 20 deviated from the center of the light irradiation unit 30 as compared with the light irradiation range depicted by the alternate long and short dash line. On this account, the time ta2, at which the illuminance of the light coming from the light irradiation unit 30 arrives at the predetermined curing illuminance I0, comes earlier than the time ta0. The curing time Ta2 of the liquid J is shorter than the curing time Ta0.

On the other hand, as depicted by the solid line in FIG. 10B, in the first gap, the controller 60 turns OFF the proximity light source 31*c*, and the controller 60 turns ON the other light sources 31 other than the proximity light source 31*c* of the light irradiation unit 30. The light irradiation range in the first gap area, which is provided when the proximity light source 31*c* is turned OFF, is narrowed on the side of the head 20 deviated from the center of the light irradiation unit 30 as compared with the light irradiation range depicted by the alternate long and short dash line. On this account, the time tb2, at which the illuminance of the light coming from the light irradiation unit 30 arrives at the predetermined curing illuminance I0, comes later than the time tb0. The curing time Tb2 of the liquid J is shorter than the curing time Tb0.

In this way, the light irradiation range of the second gap area approaches the side of the head 20, and the light irradiation range of the first gap area is separated from the side of the head 20. On this account, the curing time Ta2 of the liquid J in the second gap area mutually coincides with or approaches the curing time Tb2 of the liquid J in the first gap area. Therefore, it is possible to reduce the nonuniformity of the appearance of the cured matter of the liquid J, and it is possible to suppress the deterioration of the printing image quality which would be otherwise caused by the shape of the printing medium A.

Note that also in the second embodiment, the plurality of light source arrays 33 may include the second light source array 336 which is arranged separately from the proximity light source 31*c* as compared with the center in the left-right direction thereof as in the fourth modified embodiment. In this case, the controller 60 may supply the same electric power as that for the other light sources 31 to the second light source 31*b* in the second gap, while the controller 60 may supply the electric power larger than that for the other light sources 31 to the second light source 31*b* in the first gap. Accordingly, in the first gap area, the liquid J is temporarily cured in the curing time Tb2, and then the liquid J can be sufficiently cured by receiving the light having the high illuminance radiated by the second light source array 33*b*.

Third Embodiment

A printing apparatus 10 according to a third embodiment is provided with a head 20 which discharges the liquid to the printing medium A, a relative movement device 40 which relatively moves the printing medium A and the head 20 in the relative movement direction, a light irradiation unit 30, and a controller 60. The light irradiation unit 30 has a first light irradiation unit 30*a* which has light sources 31 for irradiating the liquid on the printing medium A with the light, a second light irradiation unit 30*b* which is arranged near to the head 20 than the first light irradiation unit 30*a* in the relative movement direction and which has light sources 31 for irradiating the liquid on the printing medium A with the light. The controller 60 turns ON the first light irradiation unit 30*a* and turns OFF the second light irradiation unit 30*b* when the gap between the light irradiation unit 30 and the printing medium A is the first gap. The controller 60 turns ON the second light irradiation unit 30*b* and turns OFF the first light irradiation unit 30*a* when the gap is the second gap which is smaller than the first gap. Note that the following explanation will be made assuming that the relative movement direction is the left-right direction. However, the arrangement of the printing apparatus 10 is not limited thereto.

Figure 11A:
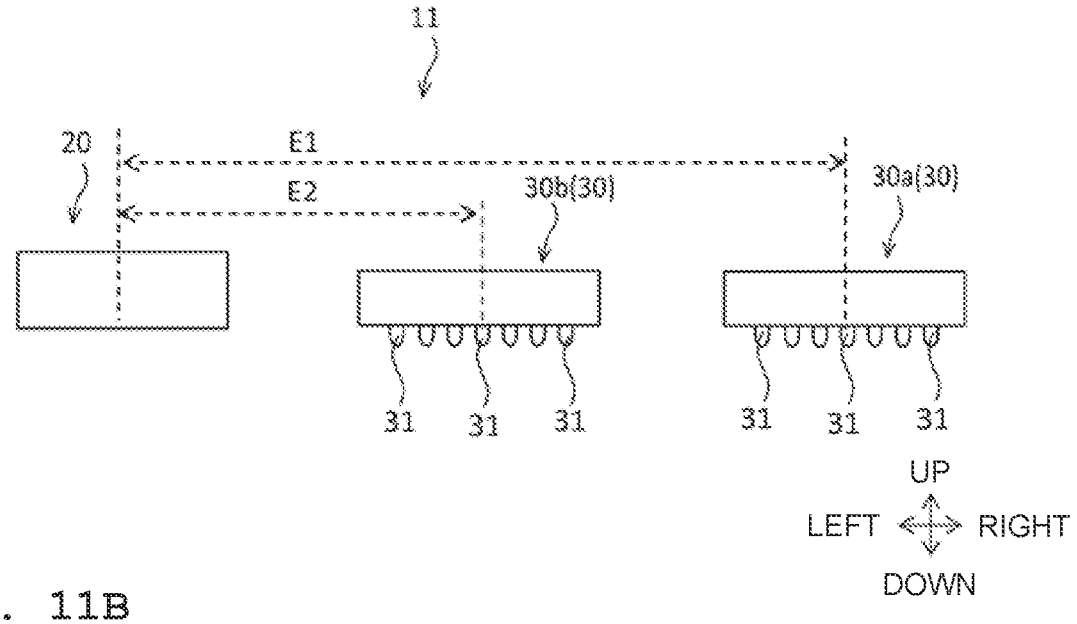
FIG. 11A is a schematic drawing as viewed from a front position of a head unit in which a head, a first light irradiation unit, and a second light irradiation unit are aligned in this order from the left side to the right side.

Specifically, as depicted in FIG. 11A, the head unit 11 is provided with the head 20 and the light irradiation unit 30. The light irradiation unit 30 has the first light irradiation unit 30*a* and the second light irradiation unit 30*b*. The first light irradiation unit 30*a* is separated farther from the head 20 as compared with the second light irradiation unit 30*b*. The space E1 between the first light irradiation unit 30*a* and the head 20 is longer than the space E2 between the second light irradiation unit 30*b* and the head 20.

The first light irradiation unit 30*a* and the second light irradiation unit 30*b* are identical with each other, for example, in relation to the intensity of the light, except for the arrangement described above. On this account, the light irradiation range of the light irradiation unit 30 is narrowed in the second gap area as compared with the first gap area. Accordingly, the curing time of the liquid J (time which elapses until the illuminance of the light arrives at the predetermined curing illuminance I0 after the liquid J is landed on the printing medium A) is long in the second gap area as compared with the first gap area. On this account, the controller 60 controls the power source circuit 67 to switch the turning ON of the first light irradiation unit 30*a* and the second light irradiation unit 30*b*.

In the exemplary case depicted in FIG. 11A, during the scanning in the printing process, the controller 60 allows the head 20 to discharge the liquid therefrom on the basis of the printing data, while moving the head unit 11 leftwardly. Further, the controller 60 allows the first light irradiation unit 30*a* and the second light irradiation unit 30*b* to radiate the light on the basis of the gap information. In this case, in the first gap, the light sources 31 of the first light irradiation unit 30*a* are turned ON, and the light sources 31 of the second light irradiation unit 30*b* are turned OFF. Accordingly, the liquid J is landed on the first gap area from the head 20, and then the liquid J on the first gap area is irradiated with the light radiated from the first light irradiation unit 30*a*. Thus, the liquid J is cured.

Further, in the second gap, the light sources 31 of the first light irradiation unit 30*a* are turned OFF, and the light sources 31 of the second light irradiation unit 30*b* are turned ON. Accordingly, the liquid J is landed on the second gap area from the head 20, and then the liquid J on the second gap area is irradiated with the light radiated from the second light irradiation unit 30*b*. Thus, the liquid J is cured. In this way, the light irradiation range of the first light irradiation unit 30*a* in the first gap area is wider than the light irradiation range of the second light irradiation unit 30*b* in the second gap area. However, the space E1 between the first light irradiation unit 30*a* and the head 20 is larger than the space E2 between the second light irradiation unit 30*b* and the head 20. On this account, the curing time of the liquid J to be cured by the first light irradiation unit 30*a* in the first gap area coincides with or approaches the curing time of the liquid. J to be cured by the second light irradiation unit 30*b* in the second gap area. As a result, it is possible to reduce the nonuniformity of the appearance of the cured matter of the liquid J, and it is possible to suppress the deterioration of the printing image quality which would be otherwise caused by the shape of the printing medium A.

Fifth Modified Embodiment

In a fifth modified embodiment, the relative movement device 40 as described in the third embodiment is provided with a carriage 42 which carries a head 20, a first light irradiation unit 30*a*, and a second light irradiation unit 30*b* and which is movable in the relative movement direction. The first light irradiation unit 30*a* and the second light irradiation unit 30*b* are arranged so that the head 20 is interposed therebetween in the relative movement direction. The controller 60 allows the head 20 to discharge the liquid therefrom and allows the first light irradiation unit 30*a* to radiate the light therefrom while moving the carriage 42 in the direction in which the second light irradiation unit 30*b* precedes the head 20 when the gap is the first gap. The controller 60 allows the head 20 to discharge the liquid therefrom and allows the second light irradiation unit 30*b* to radiate the light therefrom while moving the carriage 42 in the direction in which the first light irradiation unit 30*a* precedes the head 20 when the gap is the second gap.

Figure 11B:
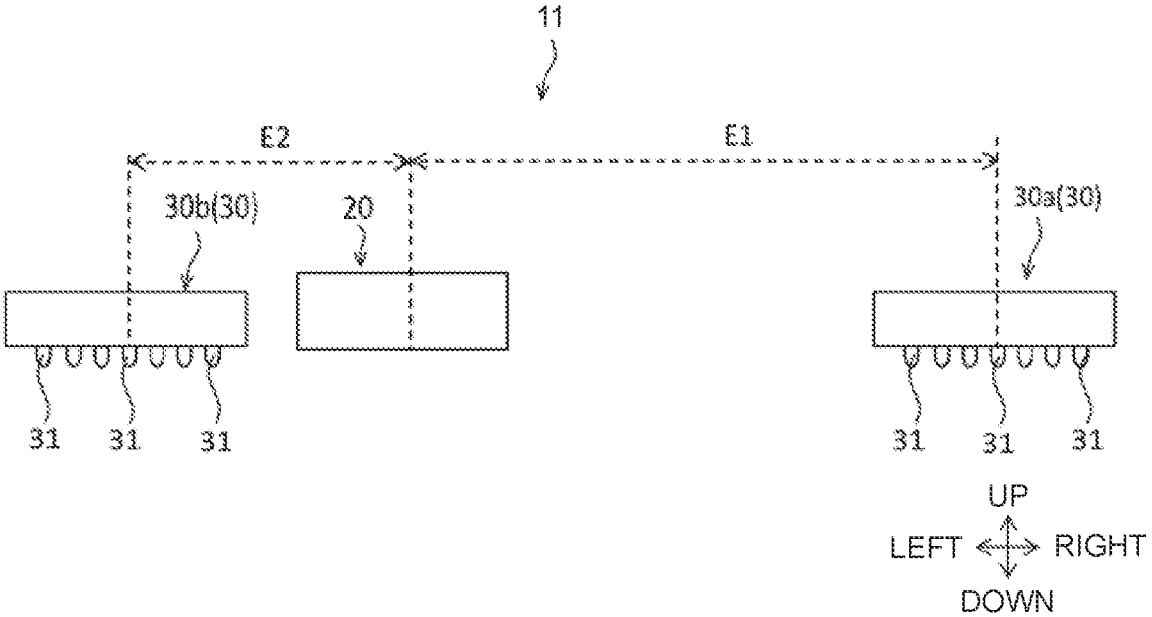
FIG. 11B is a schematic drawing as viewed from a front position of a head unit in which a second light irradiation unit, a head, and a first light irradiation unit are aligned in this order from the left side to the right side.

Specifically, as depicted in FIG. 11B, the second light irradiation unit 30*b*, the head 20, and the first light irradiation unit 30*a* are arranged while being aligned in this order from the left side to the right side in the head unit 11. The first light irradiation unit 30*a* is separated farther from the head 20 as compared with the second light irradiation unit 30*b*. The space E1 between the first light irradiation unit 30*a* and the head 20 is longer than the space E2 between the second light irradiation unit 30*b* and the head 20.

During the scanning in the printing process, the controller 60 divides the printing data into the printing data for the scanning to be used for every scanning. Further, the printing data for the scanning is divided into the printing data for the first gap and the printing data for the second gap on the basis of the gap information. Then, the controller 60 executes the first scanning. The controller 60 allows the head 20 to discharge the liquid therefrom on the basis of the printing data for the first gap while moving the head unit 11 to the left side. Further, the controller 60 turns ON the light sources 31 of the first light irradiation unit 30*a*, and the controller 60 turns OFF the light sources 31 of the second light irradiation unit 30*b*. Accordingly, the liquid J is landed on the first gap area from the head 20, and then the liquid J on the first gap area is irradiated with the light radiated from the first light irradiation unit 30*a*. The liquid J is cured, and the printing is performed on the printing medium A.

Then, the controller 60 executes the second scanning without executing the conveyance action. In the second scanning, the controller 60 allows the head 20 to discharge the liquid therefrom on the basis of the printing data for the second gap while moving the head unit 11 to the right side on the printing range brought about by the first scanning. Further, the controller 60 turns ON the light sources 31 of the second light irradiation unit 30*b*, and the controller 60 turns OFF the light sources 31 of the first light irradiation unit 30*a*. Accordingly, the liquid J is landed on the second gap area from the head 20, and then the liquid J on the second gap area is irradiated with the light radiated from the second light irradiation unit 30*b*. The liquid J is cured. Accordingly, it is possible to reduce the nonuniformity of the appearance of the cured matter of the liquid J, and it is possible to suppress the deterioration of the printing image quality which would be otherwise caused by the shape of the printing medium A.

Fourth Embodiment

In a printing apparatus 10 according to a fourth embodiment, the controller 60 controls the relative movement device 40 so that the relative movement speed between the stage 51 and the light irradiation unit 30 becomes slow when the gap of the light irradiation unit 30 with respect to the printing medium A is the first gap as compared with when the gap is the second gap which is smaller than the first gap.

In this case, the printing is performed while alternately repeating the scanning and the conveyance action for conveying the printing medium A by means of the conveying device 50, the scanning including the movement action in which the head 20 and the light irradiation unit 30 are moved by the relative movement device 40, the discharging action in which the liquid is discharged from the head 20, and the light irradiation action in which the light is radiated from the light irradiation unit 30. In this procedure, the controller 60 performs, in one scanning, the first light irradiation action for radiating the light onto the first gap area of the printing medium A in which the gap is the first gap while moving the head 20 and the light irradiation unit 30 at the first speed, and the second light irradiation action for radiating the light onto the second gap area of the printing medium A in which the gap is the second gap while moving the head 20 and the light irradiation unit 30 at the second speed which is faster than the first speed. Alternatively, the scanning includes the first scanning which does not include the second light irradiation action and which includes the first light irradiation action, and the second scanning which does not include the first light irradiation action and which include the second light irradiation action, wherein the first scanning and the second scanning are performed distinctly between the conveyance action and another conveyance action which follows the conveyance action.

Specifically, in one scanning, the controller 60 allows the head 20 to discharge the liquid J therefrom onto the printing medium A on the basis of the printing data for the scanning in accordance with the discharging action, and the controller 60 concurrently allows the light irradiation unit 30 to radiate the light therefrom onto the liquid J on the printing medium A in accordance with the light irradiation action, while moving the head unit 11 to the left side in accordance with the movement action. In this procedure, the controller 60 switches the movement speed of the light irradiation unit 30 of the head unit 11 between the first speed and the second speed on the basis of the gap information. In other words, the controller 60 moves the light irradiation unit 30 at the first speed in the first gap, and the controller 60 moves the light irradiation unit 30 at the second speed which is faster than the first speed in the second gap.

The light irradiation range in the first gap area, which is provided in accordance with the light irradiation action during the scanning, is wider than the light irradiation range in the second gap area. On the other hand, the first speed of the light irradiation unit 30 for irradiating the first gap area with the light is slower than the second speed of the light irradiation unit 30 for irradiating the second gap area with the light. On this account, the movement speed in the light irradiation unit 30 in the first gap area is slower than the movement speed of the light irradiation unit 30 in the second gap area. Therefore, the curing time of the liquid J brought about by the light irradiation unit 30 in the first gap area coincides with or approaches the curing time of the liquid J brought about by the light irradiation unit 30 in the second gap area. It is possible to reduce the nonuniformity of the appearance of the cured matter of the liquid J, and it is possible to suppress the deterioration of the printing image quality which would be otherwise caused by the shape of the printing medium A.

Note that the first light irradiation action and the second light irradiation action may be executed by means of the mutually distinct scannings. In this case, the controller 60 divides the printing data into the printing data for the scanning for every scanning. Further, the printing data for the scanning is divided into the printing data for the first gap and the printing data for the second gap on the basis of the gap information. Further, the controller 60 switches the movement speed of the head unit 11 between the first speed and the second speed on the basis of the gap information. Note that the following explanation will be made for the case in which the second scanning is executed after the execution of the first scanning. However, the first scanning may be executed after the second scanning.

Then, the controller 60 executes the first scanning to move the head unit 11 at the first speed, while in the first gap, the discharging action is executed on the basis of the printing data for the first gap, and the first light irradiation action is executed. In the discharging action, the controller 60 allows the head 20 to discharge the liquid J therefrom to the first gap area A1 without allowing the head 20 to discharge the liquid therefrom to the second gap area A2 of the printing medium A. Further, in the first light irradiation action, the controller 60 allows the light irradiation unit 30 to radiate the light therefrom onto the first gap area A1. Accordingly, the illuminance of the light in the first gap area A1 arrives at the curing illuminance I0 of the liquid J in the first curing time. The liquid J on the first gap area A1 is cured.

Then, the controller moves the head unit 11 to the right side without performing the conveyance action, and then the controller 60 executes the second scanning. In the second scanning, the controller 60 executes the discharging action in the second gap on the basis of the printing data for the second gap, and the controller 60 executes the second light irradiation action, while moving the head unit 11 to the left side at the second speed over or above the printing range brought about by the first scanning. In the discharging action, the controller 60 allows the head 20 to discharge the liquid therefrom to the second gap area. A2 without allowing the head 20 to discharge the liquid therefrom to the first gap area A1 of the printing medium A. Further, in the second light irradiation action, the controller 60 radiates the light with respect to the second gap area A2. Accordingly, the illuminance of the light in the second gap area A2 arrives at the curing illuminance I0 of the liquid J in the second curing time, and the liquid J in the second gap area A2 is cured.

The first scanning and the second scanning are executed during the period between the conveyance action and another conveyance action which follows the conveyance action. The first speed of the light irradiation unit 30 in the first light irradiation action of the first scanning is made slower than the second speed of the light irradiation unit 30 in the second light irradiation action of the second scanning. Accordingly, the movement in the light irradiation range brought about by the light irradiation unit 30 becomes slow in the first gap as compared with the second gap. The first curing time of the liquid J can coincide with or approach the second curing time. Therefore, it is possible to reduce the nonuniformity of the appearance of the cured matter of the liquid J, and it is possible to suppress the deterioration of the printing image quality which would be otherwise caused by the shape of the printing medium A.

Sixth Modified Embodiment

In a sixth modified embodiment, the controller 60 as described in the fourth embodiment performs the first light irradiation action and the second light irradiation action in one scanning if the gap fulfills a predetermined condition. If the gap does not fulfill the predetermined condition, the controller 60 distinctly performs the first scanning and the second scanning.

Figure 12A:
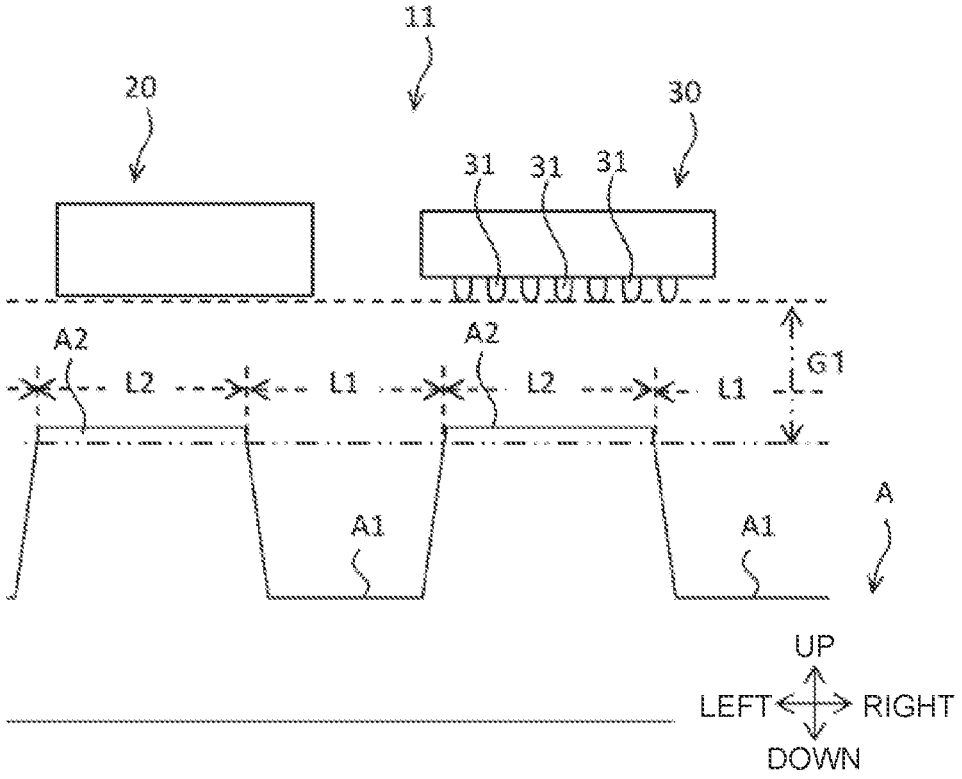
FIG. 12A is a schematic drawing of a head unit and a printing medium having projections and recesses as viewed from a front position.

Specifically, as depicted in FIG. 12A, the controller 60 acquires the length L1 of the first gap area A1 and the length L2 of the second gap area A2 in the left-right direction on the basis of the gap information. If the printing medium A has a small or no inclination, or the printing medium A has a small or no difference in level, and the lengths of both of the length L1 and the length L2 are not less than a predetermined length, then the number of times of the switching of the speed of the light irradiation unit 30 in each scanning is small or zero. In this case, assuming that a predetermined condition is fulfilled, the controller 60 changes the movement speed of the light irradiation unit 30 in one scanning to perform the first light irradiation action and the second light irradiation action.

On the other hand, if the printing medium A is provided with a large inclination or many differences in level, and at least one length of the length L1 and the length L2 is less than the predetermined length, then it is necessary that the speed of the light irradiation unit 30 should be switched in a short time during the scanning. In this case, assuming that the predetermined condition is not fulfilled, the controller 60 distinctly performs the first scanning and the second scanning. Accordingly, the controller 60 moves the light irradiation unit 30 at the first speed in the first light irradiation action during the first scanning, and the controller 60 moves the light irradiation unit 30 at the second speed in the second light irradiation action during the second scanning. Accordingly, the printing can be performed on the printing medium A in accordance with the method adapted to the shape of the printing medium A without changing the movement speed of the light irradiation unit 30 in one scanning. It is possible to suppress the deterioration of the printing image quality which would be otherwise caused by the shape of the printing medium A.

Seventh Modified Embodiment

In a seventh modified embodiment, the controller 60 as described in the sixth modified embodiment judges that the gap fulfills a predetermined condition, if the rate of change of the gap in the movement direction is less than a predetermined rate. The controller 60 judges that the gap does not fulfill the predetermined condition, if the rate of change of the gap is not less than the predetermined rate.

Figure 12B:
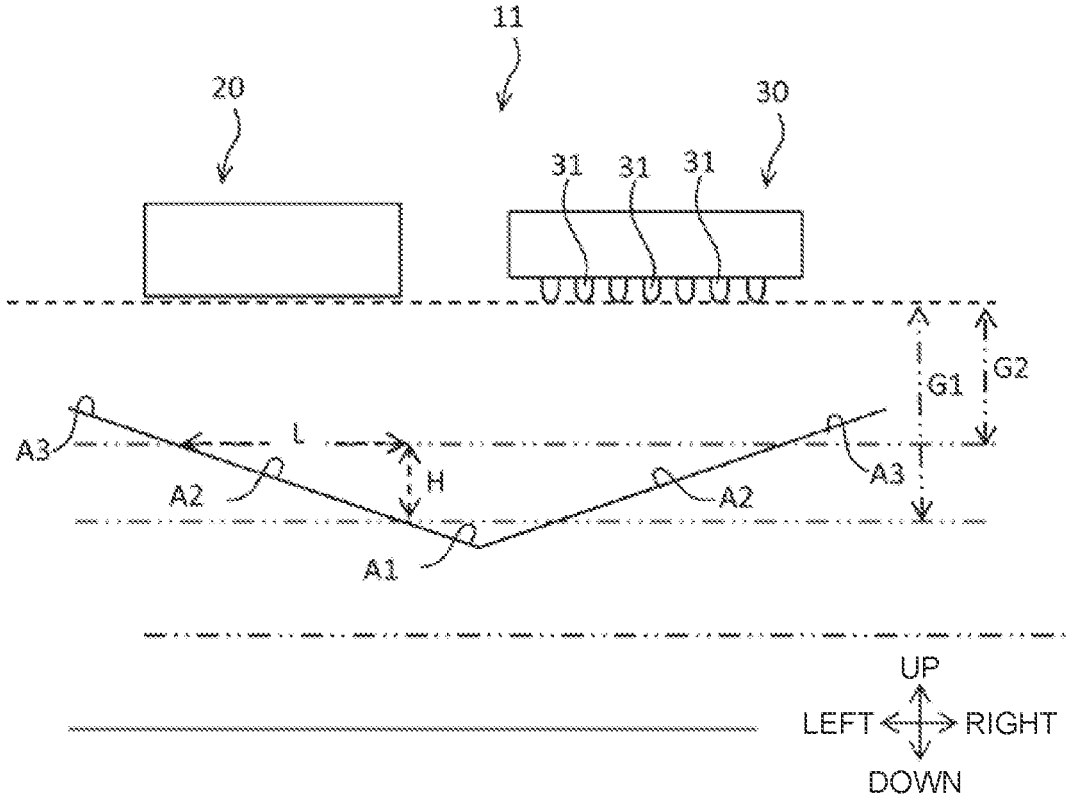
FIG. 12B is a schematic drawing of a head unit and a printing medium having inclinations as viewed from a front position.

Specifically, as depicted in FIG. 12B, the threshold value of the gap between the printing medium A and the light irradiation unit 30 includes a plurality of values (for example, a first predetermined value G1 which is the predetermined value G1 as described above, and a second predetermined value G2 which is smaller than the first predetermined value G1). In this case, the gap includes a first gap which is not less than the first predetermined value G1, a second gap which is less than the first predetermined value G1 and not less than the second predetermined value G2, and a third gap which is less than the second predetermined value G2. On this account, the printing medium A has a first gap area A1 which is an area of the first gap, a second gap area A2 which is an area of the second gap, and a third gap area A3 which is an area of the third gap.

For example, the controller 60 acquires the rate of change H/L of the gap as the length H of the gap in the upward-downward direction subjected to the change per the unit length L in the left-right direction on the basis of the gap information. If a large inclination is provided on the printing medium A, the rate of change of the gap is not less than a predetermined rate. In this case, the distance of each of the gap areas is short on the printing medium A in the left-right direction. It is necessary to switch, in a short time, the speed of the light irradiation unit 30 which is moved over or above the printing medium A. On this account, assuming that the predetermined condition is not fulfilled, the controller 60 distinctly performs the first scanning, the second scanning, and the third scanning.

Therefore, the controller 60 divides the printing data into the printing data for the scanning to be used for every scanning. Further, the printing data for the scanning is divided into the printing data for the first gap, the printing data for the second gap, and the printing data for the third gap on the basis of the gap information. Then, the controller 60 executes the first scanning. The controller 60 allows the head 20 to discharge the liquid J therefrom to the first gap area A1 on the basis of the printing data for the first gap, and the controller 60 allows the light irradiation unit 30 to radiate the light therefrom onto the first gap area A1, while moving the head unit 11 at the first speed. Accordingly, the liquid J is cured in the first curing time in the first gap area A1.

Then, the controller 60 executes the second scanning without executing the conveyance action. In the second scanning, the controller 60 allows the head 20 to discharge the liquid J therefrom to the second gap area A2 on the basis of the printing data for the second gap, and the controller 60 allows the light irradiation unit 30 to radiate the light therefrom onto the second gap area A2, while moving the head unit 11 at the second speed which is faster than the first speed over or above the priming range subjected to the printing in the first scanning. Accordingly, the liquid J is cured in the second curing time in the second gap area A2.

Further, the controller 60 executes the third scanning without executing the conveyance action. In the third scanning, the controller 60 allows the head 20 to discharge the liquid J therefrom to the third gap area A3 on the basis of the printing data for the third gap, and the controller 60 allows the light irradiation unit 30 to radiate the light therefrom onto the third gap area A3, while moving the head unit 11 at the third speed which is faster than the second speed over or above the printing range subjected to the priming in the second scanning. Accordingly, the liquid J is cured in the third curing trifle in the third gap area A3. As described above, the printing medium A is subjected to the printing in accordance with the method which is adapted to the shape of the printing medium A, without changing the movement speed of the light irradiation unit 30 in one scanning. Thus, it is possible to suppress the deterioration of the printing image quality which would be otherwise caused by the shape of the printing medium A.

On the other hand, if the printing medium A has a small or no inclination, the rate of change of the gap is less than the predetermined rate. In this case, the distance of each of the gap areas is long on the printing medium A in the left-right direction. The number of times of the switching of the speed of the light irradiation unit 30 which is moved over or above the printing medium A in one scanning is small or zero. On this account, assuming that the predetermined condition is fulfilled, the controller 60 performs the first light irradiation action, the second light irradiation action, and the third light irradiation action in one scanning. Accordingly, the controller 60 allows the head unit 11 to move at the first speed in the first light irradiation action, the controller 60 allows the head unit 11 to move at the second speed in the second light irradiation action, and the controller 60 allows the head unit 11 to move at the third speed in the third light irradiation action. As described above, the movement speed of the light irradiation unit 30 is changed in one scanning. As described above, the printing medium A is subjected to the printing in accordance with the method which is adapted to the shape of the printing medium A, and thus it is possible to suppress the deterioration of the printing image quality which would be otherwise caused by the shape of the printing medium A.

Eighth Modified Embodiment

In a printing apparatus 10 according to an eighth modified embodiment, the controller 60 as described in the fourth embodiment and the sixth and seventh modified embodiments is operated as follows. That is, when the first scanning and the second scanning are performed distinctly, if the first scanning is executed after executing the second scanning, then the first gap area is irradiated with the light in addition to the second gap area in the first scanning.

Specifically, the controller 60 allows the head 20 to discharge the liquid therefrom to the second gap area A2, and then the controller 60 allows the light irradiation unit 30 to radiate the light therefrom onto the second gap area A2 by using the head unit 11 which is moved at the second speed in the second scanning. Then, the controller 60 moves the head unit 11 to the right side without conveying the printing medium A. and then the controller 60 executes the first scanning.

In this case, the controller 60 allows the head 20 to discharge the liquid J therefrom to the first gap area A1, and then the controller 60 allows the light irradiation unit 30 to radiate the light therefrom onto the first gap area A1 and the second gap area A2 by using the head unit 11 which is moved at the first speed. Accordingly, the liquid J in the first gap area A1 and the liquid J in the second gap area A2 are irradiated with the light, and thus the liquid J is cured. In this procedure, the illuminance of the light in the first gap area A1 is smaller than that in the second gap area A2. However, the liquid J in the first gap area A1 is irradiated with the light during both of the first scanning and the second scanning. On this account, it is possible to sufficiently cure the liquid J in the first gap area. A1.

Fifth Embodiment

In a printing apparatus 10 according to a fifth embodiment, a plurality of nozzles 21 form a plurality of nozzle arrays 26 which are arranged in the first direction. Each of the nozzle arrays 26 is configured by the plurality of nozzles 21 which are aligned in the second direction intersecting with the first direction. The plurality of nozzle arrays 26 include first nozzle arrays 26*a*, and second nozzle arrays 26*b* which are disposed near to the light irradiation unit 30 as compared with the first nozzle arrays 26*a*. If the gap of the printing medium A with respect to the light irradiation unit 30 is the first gap, the controller 60 allows the nozzles 21 of the first nozzle arrays 26*a* to discharge the liquid J therefrom without allowing the nozzles 21 of the second nozzle arrays 26*b* to discharge the liquid therefrom. If the gap is the second gap which is smaller than the first gap, the controller 60 allows the nozzles 21 of the second nozzle arrays 26*b* to discharge the liquid J therefrom without allowing the nozzles 21 of the first nozzle arrays 26*a* to discharge the liquid therefrom.

In this case, the controller 60 performs the printing while alternately repeating the scanning and the conveyance action for conveying the printing medium A by means of the conveying device 50, the scanning including the movement action in which the head 20 and the light irradiation unit 30 are moved by the relative movement device 40, the discharging action in which the liquid J is discharged from the head 20, and the light irradiation action in which the light is radiated from the light irradiation unit 30. In this procedure, the first discharging action in which the liquid J is discharged from the first nozzle arrays 26*a* to the first gap area of the printing medium A having the gap as the first gap, and the second discharging action in which the liquid J is discharged from the second nozzle arrays 26*b* to the second gap area of the printing medium A having the gap as the second gap are performed in one scanning. Alternatively, the scanning includes the first scanning which includes the first discharging action without including the second discharging action, and the second scanning which includes the second discharging action without including the first discharging action. The first scanning and the second scanning are performed distinctly between the conveyance action and another conveyance action which follows the conveyance action.

Figure 13A:
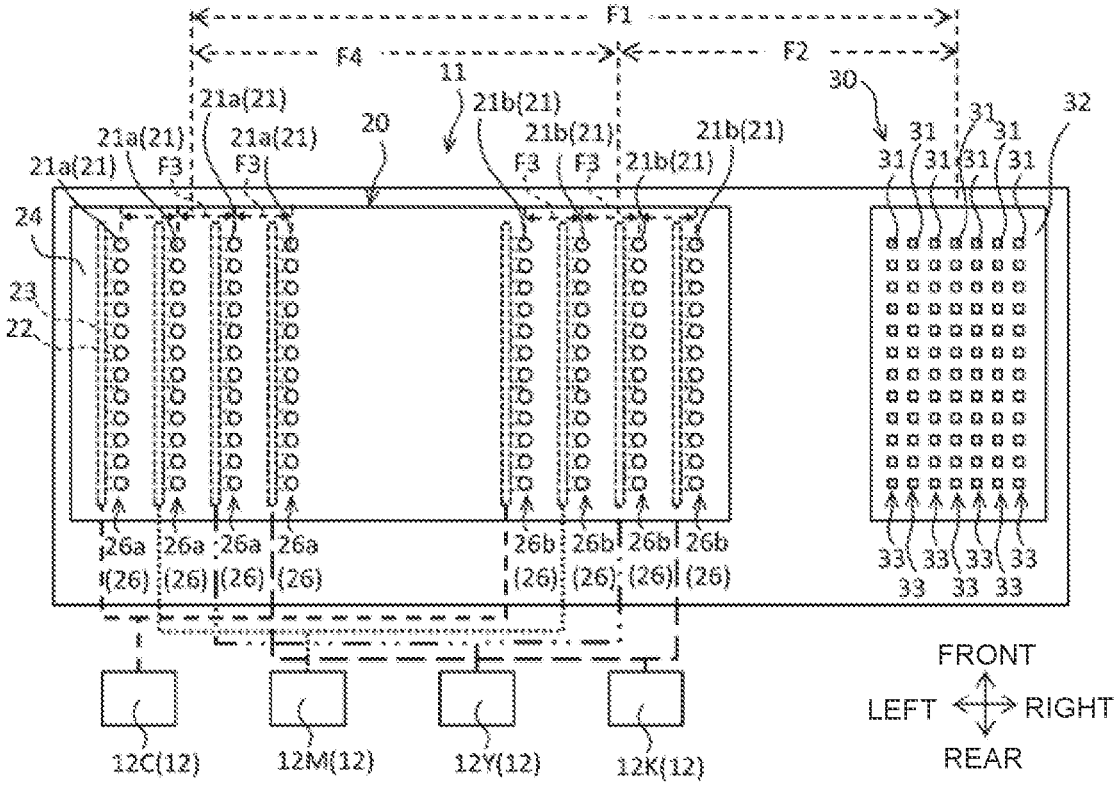
FIG. 13A is a schematic drawing of a head unit, as viewed from a lower position, in which a first nozzle array and a second nozzle array are aligned so that first nozzles and second nozzles are overlapped with each other when the left side is viewed from the right side.

For example, in an exemplary case depicted in FIG. 13A, the tank 12 includes a tank 12C for the cyan, a tank 12M for the magenta, a tank 12Y for the yellow, and a tank 12K for the black. The tank 12C for the cyan accommodates a cyan liquid, the tank 12M for the magenta accommodates a magenta liquid, the tank 12Y for the yellow accommodates a yellow liquid, and the tank 12K for the black accommodates a black liquid.

Further, in the head unit 11, the head 20 has the eight nozzle arrays 26. The eight nozzle arrays 26 include the first nozzle array 26*a* and the second nozzle array 26*b* for the cyan, the first nozzle array 26*a* and the second nozzle array 26*b* for the magenta, the first nozzle array 26*a* and the second nozzle array 26*b* for the yellow, and the first nozzle array 26*a* and the second nozzle array 26*b* for the black. Each of the nozzle arrays 26 for the cyan includes the nozzles 21 which are connected to the tank 12C for the cyan by liquid flow passages, and the nozzles 21 discharge the cyan liquid supplied from the tank 12C for the cyan. Each of the nozzle arrays 26 for the magenta includes the nozzles 21 which are connected to the tank 12M for the magenta by liquid flow passages, and the nozzles 21 discharge the magenta liquid supplied from the tank 12M for the magenta. Each of the nozzle arrays 26 for the yellow includes the nozzles 21 which are connected to the tank 12Y for the yellow by liquid flow passages, and the nozzles 21 discharge the yellow liquid supplied from the tank 12Y for the yellow. Each of the nozzle arrays 26 for the black includes the nozzles 21 which are connected to the tank 12K for the black by liquid flow passages, and the nozzles 21 discharge the black liquid supplied from the tank 12K for the black. Note that the first nozzle array 26*a* and the second nozzle array 26*b* for each of the liquids may be connected to mutually different tanks 12.

The first nozzle array 26*a* for the cyan, the first nozzle array 26*a* for the magenta, the first nozzle array 26*a* for the yellow, the first nozzle array 26*a* for the black, the second nozzle array 26*b* for the cyan, the second nozzle array 26*b* for the magenta, the second nozzle array 26*b* for the yellow, and the second nozzle array 26*b* for the black are arranged while providing the spaces in the left-right direction. When the arrangement is viewed in the direction directed from the right side to the left side, the arrangement is made so that the nozzles 21 of the respective nozzle arrays 26 are overlapped with each other.

In relation to each of the colors, the first nozzle array 26*a* is arranged on the left side as compared with the second nozzle array 26*b*. In the left-right direction, the first space F1 between the first nozzle array 26*a* and the light irradiation unit 30 is larger than the second space F2 between the second nozzle array 26*b* and the light irradiation unit 30.

In the scanning during the printing process, the controller 60 divides the printing data into the printing data for the scanning to be used for every scanning. Further, the printing data for the scanning is divided into the printing data for the first gap and the printing data for the second gap on the basis of the gap information. Then, the controller 60 executes the first scanning. In the first scanning, the controller 60 allows the head 20 to discharge the liquid therefrom to the printing medium A. and the controller 60 allows the light irradiation unit 30 to radiate the light therefrom onto the printing medium A, while moving the head unit 11 to the left side.

Figure 14A:
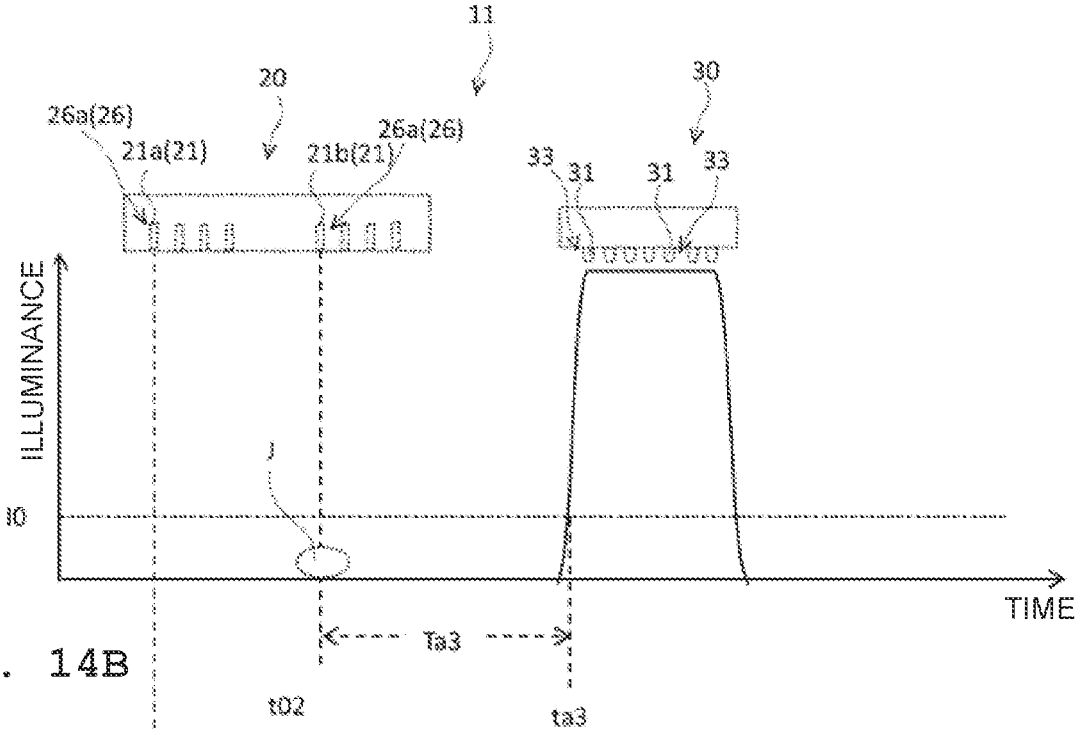
FIG. 14A is a graph illustrative of the time-dependent change of the illuminance of the light when the liquid is discharged to a second gap area from a second nozzle array.

In this case, in order to discharge the cyan liquid, the liquid is discharged from any nozzle 21 of the first nozzles 21*a* as the nozzles 21 of the first nozzle array 26*a* and the second nozzles 21*b* as the nozzles 21 of the second nozzle array 26*b*. On this account, as depicted in FIG. 14A, the controller 60 executes the second discharging action in the second gap on the basis of the printing data for the second gap to discharge the liquid J from the second nozzles 21*b* of the head 20. In this situation, the illuminance of the light on the printing medium A arrives at the predetermined curing illuminance I0 in the time ta3 after the liquid J is landed on the printing medium A at the time t02. The liquid is cured in the curing time Ta3 provided therebetween.

Figure 14B:
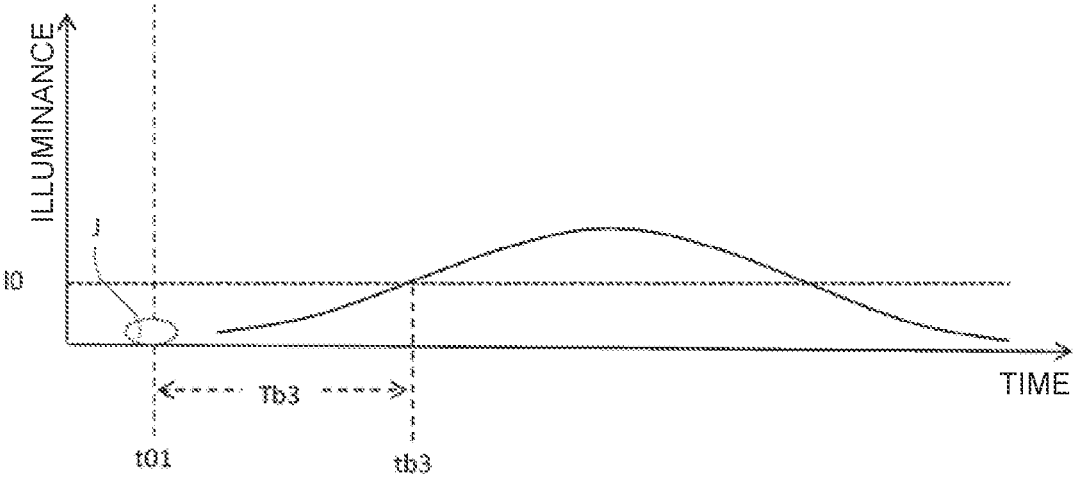
FIG. 14B is a graph illustrative of the time-dependent change of the illuminance of the light when the liquid is discharged to a first gap area from a first nozzle array.

Further, as depicted in FIG. 14B, the controller 60 executes the first discharging action in the first gap on the basis of the printing data for the first gap to discharge the liquid J from the first nozzles 21*a* of the head 20. In this situation, the illuminance of the light on the printing medium A arrives at the predetermined curing illuminance I0 in the time tb3 after the liquid J is landed on the printing medium A at the time t01. The liquid J is cured in the curing time Tb3 provided therebetween.

The light irradiation range of the light irradiation unit 30 in the first gap is wider than the light irradiation range in the second gap. On the other hand, in the second gap, the liquid J is discharged from the second nozzles 21*b* which are disposed near to the light irradiation unit 30 as compared with the first nozzles 21*a*. On this account, the curing time Tb3 coincides with or approaches the curing time Ta3. It is possible to reduce the nonuniformity of the appearance of the cured matter of the liquid J, and it is possible to suppress the deterioration of the printing image quality which would be otherwise caused by the shape of the printing medium A.

Note that as depicted in FIG. 13A, in the left-right direction, the space between the mutually adjoining first nozzle arrays 26*a* and the space between the mutually adjoining second nozzle arrays 26*b* are F3. On this account, there are differences (spaces F3) between the first spaces F1 between the first nozzle arrays 26*a* of the cyan, the magenta, the yellow, and the black and the light irradiation unit 30. Further, there are also differences (spaces F3) between the second spaces F2 between the second nozzle arrays 26*b* of the cyan, the magenta, the yellow, and the black and the light irradiation unit 30. Accordingly, the difference arises in the curing time until the liquid J discharged from each of the nozzle arrays 26 is cured by the light coming from the light irradiation unit 30.

However, the space F3 between the nozzle arrays 26 is extremely smaller than the space F4 between the first nozzle array 26*a* and the second nozzle array 26*b*, the first space F1, and the second space F2. On this account, the difference in the curing time of the liquid J, which is brought about by the space F3 between the nozzle arrays 26, is extremely smaller than the curing time of the liquid J concerning each of the nozzle arrays 26. Therefore, there is little difference in the appearance of the cured matter of the liquid J which would be otherwise caused by the difference in the curing time of the liquid J brought about by the space F3 between the nozzle arrays 26.

Further, the first discharging action and the second discharging action may be executed in accordance with mutually distinct scannings. In this case, the controller 60 executes the second scanning. The controller 60 executes the second discharging action on the basis of the printing data for the second gap, and the controller 60 executes the light irradiation action, while moving the head unit 11 at the predetermined speed. In the second discharging action, the controller 60 allows the second nozzles 21*b* to discharge the liquid J therefrom with respect to the second gap area without allowing the head 20 to discharge the liquid therefrom with respect to the first gap area. Further, in the light irradiation action, the controller 60 is operated so that the second gap area is irradiated with the light. Accordingly, the illuminance of the light in the second gap area arrives at the curing illuminance I0 of the liquid J in the second curing time Ta3, and the liquid J in the second gap area is cured. Note that in the light irradiation action, the first gap area may be irradiated with the light, or the first gap area may not be irradiated with the light.

Then, the controller 60 moves the head unit 11 to the right side without conveying the printing medium A, and then the controller 60 executes the first scanning, in the first scanning, the controller 60 executes the first discharging action on the basis of the printing data for the first gap, and the controller 60 executes the light irradiation action, while moving the head unit 11 to the left side at the predetermined speed over or above the printing range brought about by the second scanning. In the first discharging action, the controller 60 allows the first nozzles 21*a* to discharge the liquid J therefrom with respect to the first gap area without allowing the head 20 to discharge the liquid therefrom with respect to the second gap area of the printing medium A. Further, in the light irradiation action, the controller 60 is operated so that the first gap area is irradiated with the light. Accordingly, the illuminance of the light in the first gap area arrives at the curing illuminance I0 of the liquid J in the first curing time Tb3, and the liquid J in the first gap area is cured. Nate that in the light irradiation action, the second gap area may be irradiated with the light, or the second gap area may not be irradiated with the light.

The first scanning and the second scanning are executed between the conveyance action and another conveyance action which follows the conveyance action. The first nozzles 21*a*, which discharge the light in the first discharging action during the first scanning, are separated farther from the light irradiation unit 30 as compared with the second nozzles 21*b* which discharge the liquid in the second discharging action during the second scanning. Accordingly, the first curing time Tb3 of the liquid J can coincide with or approach the second curing time Ta3. Therefore, it is possible to reduce the nonuniformity of the appearance of the cured matter of the liquid J, and it is possible to suppress the deterioration of the printing image quality which would be otherwise caused by the shape of the printing medium A.

Ninth Modified Embodiment

In a ninth modified embodiment, the controller 60 as described in the fifth embodiment is operated as follows. That is, if the gap fulfills a predetermined condition, the controller 60 performs the first discharging action and the second discharging action in one scanning. If the gap does not fulfill the predetermined condition, the controller 60 distinctly performs the first scanning and the second scanning.

Specifically, as depicted in FIG. 12A, the controller 60 acquires the length L1 of the first gap area A1 and the length L2 of the second gap area A2 in the left-right direction on the basis of the gap information. If the printing medium A has a small or no inclination, or the printing medium A has a small or no difference in level, and the lengths L1, L2 are not less than a predetermined length, then the number of times of the switching of the first discharging action and the second discharging action of the head 20 is small or zero. In this case, the controller 60 determines that the predetermined condition is fulfilled, and the controller 60 performs the first discharging action and the second discharging action of the head 20 in one scanning.

On the other hand, if the printing medium A is provided with a large inclination or many differences in level, and the lengths L1, L2 are less than the predetermined length, then it is necessary that the first discharging action and the second discharging action of the head 20 should be switched in a short time in the scanning. In this case, the controller 60 determines that the predetermined condition is not fulfilled, and the controller 60 distinctly performs the first scanning and the second scanning. Accordingly, the controller 60 allows the first nozzles 21*a* to discharge the liquid therefrom in the first discharging action during the first scanning, and the controller 60 allows the second nozzles 21*b* to discharge the liquid therefrom in the second discharging action during the second scanning. In this way, the printing medium A is subjected to the printing in accordance with the method adapted to the shape of the printing medium A without changing the nozzles 21 for discharging the liquid in one scanning. Accordingly, it is possible to suppress the deterioration of the printing image quality which would be otherwise caused by the shape of the printing medium A.

Note that the controller 60 may be operated as follows. That is, if the rate of change of the gap in the movement direction is less than a predetermined rate, the gap fulfills the predetermined condition. If the rate of change of the gap is not less than the predetermined rate, the gap does not fulfill the predetermined condition. In this case, as depicted in FIG. 12B, the controller 60 acquires the rate of change H/L of the gap as the length H of the gap in the upward-downward direction to cause the change per unit length L in the left-right direction on the basis of the gap information. If the rate of change is not less than a predetermined rate, then the controller 60 may determine that the predetermined condition is not fulfilled, and the first scanning and the second scanning may be performed distinctly. On the other hand, if the rate of change H/L is less than the predetermined rate, then the controller 60 may determine that the predetermined condition is fulfilled, and the first scanning and the second scanning may be performed in one scanning.

Tenth Modified Embodiment

In a tenth modified embodiment in relation to the fifth embodiment and the ninth modified embodiment, if the first nozzles 21*a* and the second nozzles 21*b* are viewed from one side in the first direction, then the first nozzles 21*a*, and the second nozzles 21*b* are not overlapped with each other, and the first nozzles 21*a* and the second nozzles 21*b* are positioned while being deviated by predetermined nozzle spaces in the second direction. In this case, when the first scanning and the second scanning are performed distinctly, the controller 60 conveys the printing medium A in an amount corresponding to the nozzle space between any one scanning of the first scanning and the second scanning and the other scanning.

Figure 13B:
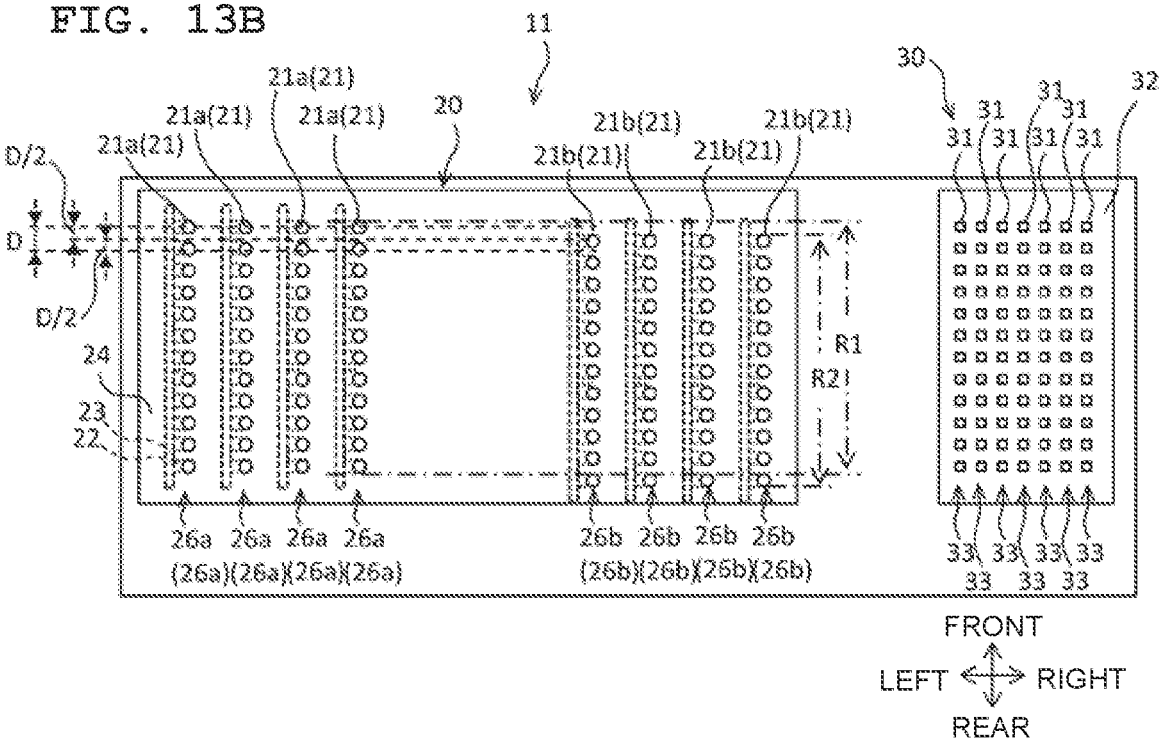
FIG. 13B is a schematic drawing of a head unit, as viewed from a lower position, in which a first nozzle array and a second nozzle array are aligned so that first nozzles and second nozzles are deviated with each other when the left side is viewed from the right side.

Specifically, as depicted in FIG. 13B, the first nozzles 21*a* and the second nozzles 21*b* for each of the liquids are not overlapped with each other in the left-right direction, and the positions thereof are deviated from each other in the front-rear direction. For example, the first nozzles 21*a* and the second nozzles 21*b* are deviated from each other in the front-rear direction so that the second nozzles 21*b* are arranged at middle positions between the first nozzles 21*a* which are adjacent to one another in the front-rear direction if the nozzles are viewed from the right side. In this case, the deviation amount between the first nozzle 21*a* and the second nozzle 21*b* is a half D/2 of the space D between the first nozzles 21*a* which are adjacent to one another in the front-rear direction.

For example, when the high image quality printing is performed on the printing medium A having small or no projections and recesses, the controller 60 performs the discharging action by using the first nozzles 21*a* and the second nozzles 21*b*. Accordingly, the liquid coming from the second nozzle 21*b* is landed between the landing position of the liquid coining from the first nozzle 21*a* and the landing position of the liquid coming from another first nozzle 21*a* adjacent to the first nozzle 21*a* in the front-rear direction. Therefore, the resolution of the image is increased, and the improvement in the image quality is effected.

On the other hand, in the case of the printing medium A having large projections and recesses, for example, the first nozzles 21*a* are used for the printing in the first gap area A1, and the second nozzles 21*b* are used for the printing in the second gap area A2. In this case, the controller 60 performs the first scanning and the second scanning distinctly. In this procedure, the controller 60 executes the first scanning. The liquid is discharged to the first gap area. A1 of the printing medium A from the first nozzles 21*a*, and the light is radiated onto the printing medium A from the light irradiation unit 30, while moving the head unit 11 at a predetermined speed to the left side.

The first printing range, which is subjected to the printing on the printing medium A in accordance with the first scanning, is the range R1 which corresponds to the first nozzle arrays 26*a* in the front-rear direction. On the other hand, the second printing range, which is subjected to the printing on the printing medium A in accordance with the second scanning, is the range R2 which corresponds to the second nozzle arrays 26*b* in the front-rear direction. The first printing range and the second printing range are deviated from each other by the deviation amount D/2 between the first nozzle 21*a* and the second nozzle 21*b*. On this account, the controller 60 conveys the printing medium A frontwardly by the deviation amount D/2 between the first nozzle 21*a* and the second nozzle 21*b* after the first scanning.

Then, the controller 60 performs the second scanning after moving the head unit 11 to the right side. In the second scanning, the controller 60 allows the second nozzles 21*b* to discharge the liquid therefrom to the second gap area of the printing medium A, and the controller 60 allows the light irradiation unit 30 to radiate the light therefrom onto the printing medium A, while moving the head unit 11 at the predetermined speed to the left side. The second printing range, which is brought about by the second scanning, is overlapped with the first printing range in the front-rear direction. On this account, it is possible to suppress the deterioration of the image which would be otherwise caused by the deviation between the first nozzle 21*a* and the second nozzle 21*b* in the front-rear direction.

Then, the controller 60 executes the conveyance action after the second scanning. In the conveyance action, the controller 60 conveys the printing medium A frontwardly by the distance corresponding to the second printing range. Accordingly, the image is printed in accordance with the first scanning and the second scanning performed present time, adjacently backwardly to the image having been printed by the first scanning and the second scanning performed last time. In this way, the first scanning and the second scanning and the conveyance action are alternately repeated, and thus the image based on the printing data is printed on the printing medium A.

Eleventh Modified Embodiment

In a printing apparatus 10 according to an eleventh modified embodiment, the head 20 as described in the fifth embodiment and the ninth and tenth modified embodiments includes a first head 20*a* which has first nozzle arrays 26*a* for discharging a first liquid, and a second head 20*b* which has second nozzle arrays 26*b* for discharging a second liquid having a viscosity higher than that of the first liquid.

Figure 15A:
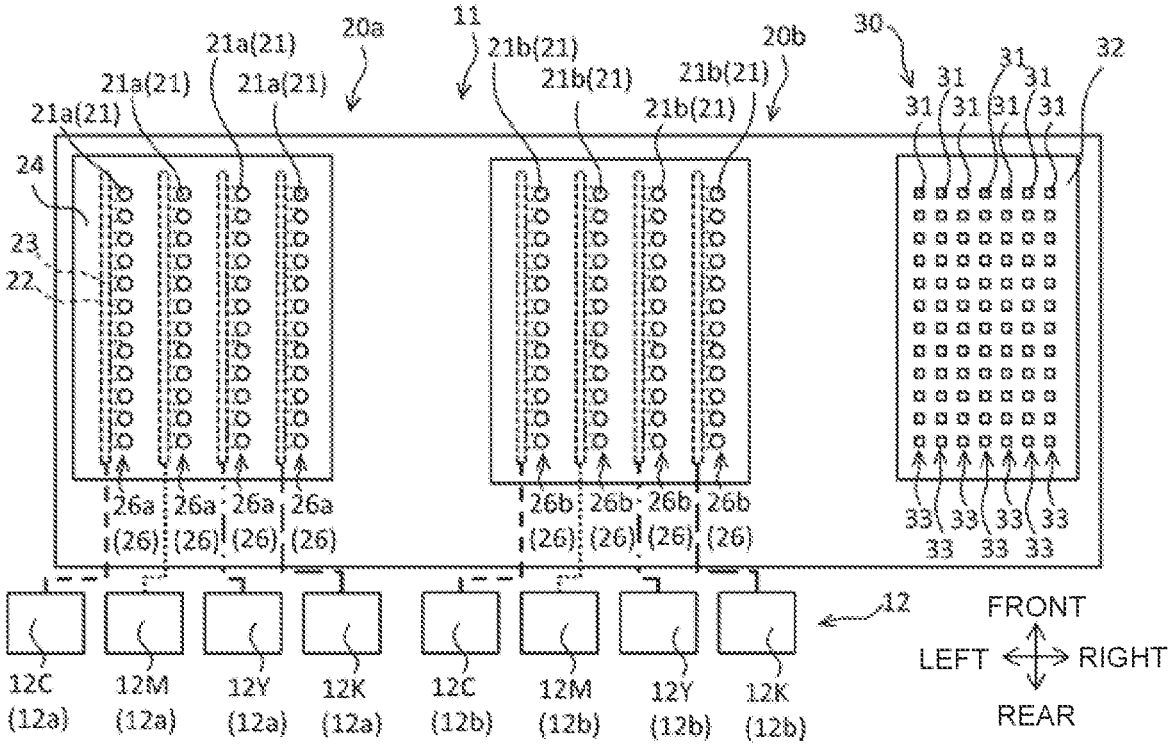
FIG. 15A is a schematic drawing as viewed from a lower position of a head unit, in which a first head, a second head, and a light irradiation unit are aligned in this order from the left side to the right side.

Specifically, for example, tanks 12 depicted in FIG. 15A include first tanks 12*a* which accommodate first liquids and second tanks 12*b* which accommodate second liquids having viscosities higher than those of the first liquids. The first tanks 12*a* include a tank 12C for the cyan, a tank 12M for the magenta, a tank 12Y for the yellow, and a tank 12K for the black. Further, the second tanks 12*b* also include a tank 12C for the cyan, a tank 12M for the magenta, a tank 12Y for the yellow, and a tank 12K for the black. The cyan liquid, which is accommodated in the tank 12C for the cyan of the second tank 12*b*, has the viscosity higher than that of the cyan liquid which is accommodated in the tank 12C for the cyan of the first tank 12*a*. Note that the viscosities, which are the same as or equivalent to the viscosity of the cyan liquid, are also provided for the other liquids.

Further, the head unit 11 has the first head 20*a*, the second head 20*b*, and a light irradiation unit 30. These components are arranged while being aligned in this order from the left side to the right side. The first space between the first head 20*a* and the light irradiation unit 30 is equal to the second space between the second head 20*b* and the light irradiation unit 30. For example, the first head 20*a* has the first nozzle arrays 26*a* of the cyan, the magenta, the yellow, and the black. The second head 20*b* has the second nozzle arrays 26*b* of the cyan, the magenta, the yellow, and the black.

The first nozzle 21*a* included in the first nozzle array 26*a* for the cyan is connected to the tank 12C for the cyan of the first tank 12*a*, the first nozzle 21*a* included in the first nozzle array 26*a* for the magenta is connected to the tank 12M for the magenta of the first tank 12*a*, the first nozzle 21*a* included in the first nozzle array 26*a* for the yellow is connected to the tank 12Y for the yellow of the first tank 12*a*, and the first nozzle 21*a* included in the first nozzle array 26*a* for the black is connected to the tank 12K for the black of the first tank 12*a*. Further, the second nozzle 21*b* included in the second nozzle array 26*b* for the cyan is connected to the tank 12C for the cyan of the second tank 12*b*, the second nozzle 21*b* included in the second nozzle array 26*b* for the magenta is connected to the tank 12M for the magenta of the second tank 12*b*, the second nozzle 21*b* included in the second nozzle array 26*b* for the yellow is connected to the tank 12Y for the yellow of the second tank 12*b*, and the second nozzle 21*b* included in the second nozzle array 26*b* for the black is connected to the tank 12K for the black of the second tank 12*b*. On this account, the cyan liquids are discharged from the first nozzles 21*a* and the second nozzles 21*b*. However, the viscosity of the second liquid discharged from the second nozzles 21*b* is higher than the viscosity of the first liquid discharged from the first nozzles 21*a*. Note that the viscosities of the other liquids are the same as or equivalent to those of the cyan liquid.

When the printing process is executed with the printing apparatus 10 as described above, the controller 60 divides the printing data into the printing data for the scanning to be used for every scanning. Further, the printing data for the scanning is divided into the printing data for the first gap and the printing data for the second gap on the basis of the gap information. In the scanning, the controller 60 allows the head 20 to discharge the liquids therefrom, and the controller 60 allows the light irradiation unit 30 to radiate the light therefrom onto the printing medium A, while moving the head unit 11 leftwardly.

In this case, the controller 60 allows the first nozzles 21*a* to discharge the first liquids therefrom to the first gap area A1 on the basis of the printing data for the first gap, and the controller 60 allows the second nozzles 21*b* to discharge the second liquids therefrom to the second gap area A2 on the basis of the printing data for the second gap. In this procedure, the second liquid, which has the viscosity higher than that of the first liquid, has the discharging tinning which is later than that of the first liquid. On this account, the curing time of the liquid in the second gap area A2 can coincide with or approach the curing time of the liquid in the first gap area A1. As a result, it is possible to reduce the nonuniformity of the appearance of the cured matter of the liquid and it is possible to suppress the deterioration of the printing image quality which would be otherwise caused by the shape of the printing medium A.

Sixth Embodiment

A printing apparatus 10 according to a sixth embodiment is provided with a first head 20*a* which has first nozzles 21*a* for discharging first liquids to the printing medium A, a second head 20*b* which has second nozzles 21*b* fix discharging second liquids having the viscosities higher than those of the first liquids to the printing medium A, a light irradiation unit 30 which is arranged between the first head 20*a* and the second head 20*b* and which radiates the light onto the liquids on the printing medium A, and a controller 60. The controller 60 allows the first nozzles 21*a* to discharge the first liquids therefrom without allowing the second nozzles 21*b* to discharge the second liquids therefrom if the gap of the printing medium A with respect to the light irradiation unit 30 is the first gap. The controller 60 allows the second nozzles 21*b* to discharge the second liquids therefrom without allowing the first nozzles 21*a* to discharge the first liquids therefrom if the gap is the second gap which is smaller than the first gap.

Figure 15B:
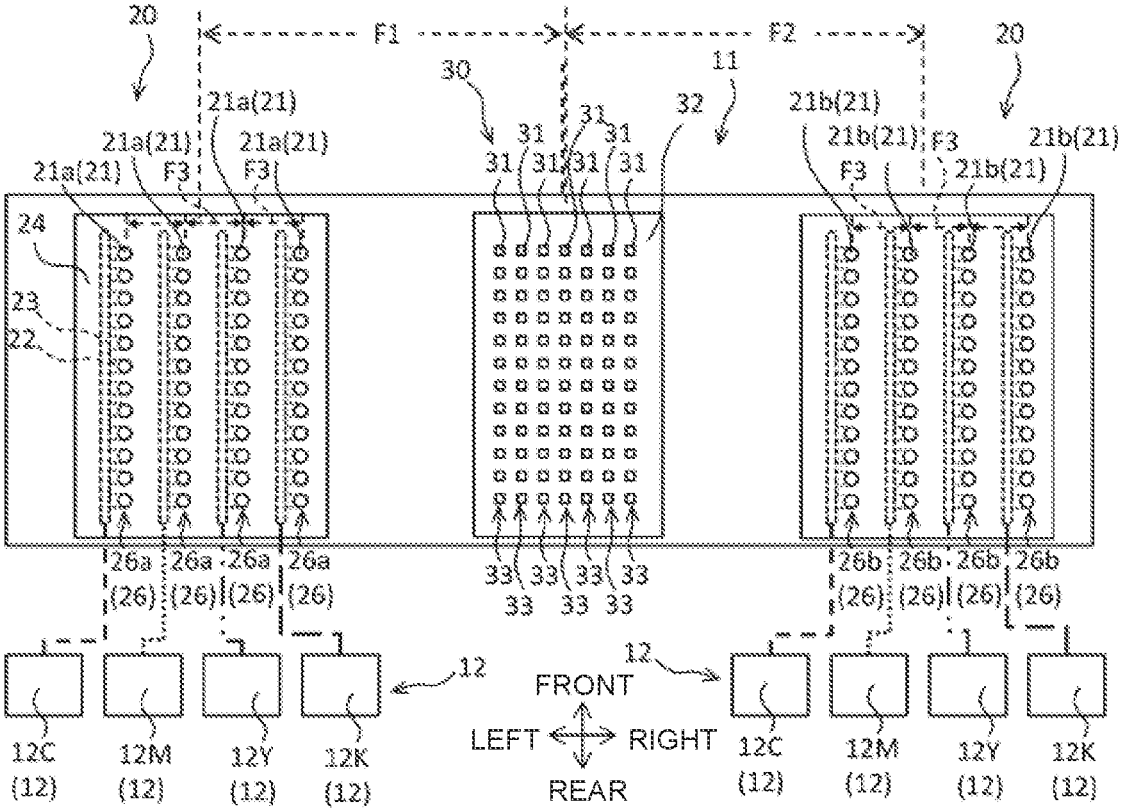
FIG. 15B is a schematic drawing as viewed from a lower position of a head unit, in which a first head, a light irradiation unit, and a second head are aligned in this order from the left side to the right side.

Specifically, tanks 12 depicted in FIG. 15B include first tanks 12*a* which accommodate first liquids and second tanks 12*b* which accommodate second liquids having viscosities higher than those of the first liquids. The first tanks 12 include a tank 12C for the cyan, a tank 12M for the magenta, a tank 12Y for the yellow, and a tank 12K for the black. Further, the second tanks 12*b* also include a tank 12C for the cyan, a tank 12M for the magenta, a tank 12Y for the yellow, and a tank 12K for the black. The cyan liquid, which is accommodated in the tank 12C for the cyan of the second tank 12*b*, has the viscosity higher than that of the cyan liquid which is accommodated in the tank 12C for the cyan of the first tank 12*a*. Note that the viscosities, which are the same as or equivalent to the viscosity of the cyan liquid, are also provided for the other liquids.

Further, the head unit 11 has the first head 20*a*, a light irradiation unit 30, and the second head 20*b*. The first head 20*a*, the light irradiation unit 30, and the second head 20*b* are arranged while being aligned in this order from the left side to the right side. The first space F1 between the first head 20*a* and the light irradiation unit 30 is equal to the second space F2 between the second head 20*b* and the light irradiation unit 30.

The first head 20*a* has the first nozzle array 26*a* of the cyan, the first nozzle array 26*a* of the magenta, the first nozzle array 26*a* of the yellow, and the first nozzle array 26*a* of the black. These nozzle arrays 26 are arranged while being aligned in this order from the left side to the right side. Further, the second head 20*b* has the second, nozzle array 26*b* of the cyan, the second nozzle array 26*b* of the magenta, the second nozzle array 26*b* of the yellow, and the second nozzle array 26*b* of the black. These nozzle arrays 26 are arranged while being aligned in this order from the left side to the right side.

When the printing process is executed with the printing apparatus 10 as described above, the controller 60 divides the printing data into the printing data for the scanning to be used for every scanning. Further, the printing data for the scanning is divided into the printing data for the first gap and the printing data for the second gap on the basis of the gap information. The controller 60 executes the first scanning and the second scanning distinctly. Note that the following explanation will be made for a case in which the first scanning is executed after the execution of the second scanning. However, the second scanning may be executed after the first scanning.

The controller 60 executes the second scanning. The second discharging action is executed on the basis of the printing data for the second gap, and the light is radiated, onto the second gap area A2 from the light irradiation unit 30, while moving the head unit 11 at a predetermined speed to the left side. In the second discharging action, the controller 60 allows the second head 206 to discharge the second liquids therefrom to the second gap area A2 without allowing the first head 20*a* to discharge the first liquids therefrom to the first gap area A1. Accordingly, the illuminance of the light in the second gap area arrives at the liquid curing illuminance I0 in the second curing time. The liquids in the second gap area A2 are cured.

Then, the controller 60 executes the first scanning without performing the conveyance action. The first discharging action is executed on the basis of the printing data for the first gap, and the light is radiated onto the first gap area A1 from the light irradiation unit 30, while moving the head unit 11 at a predetermined speed to the right side. In the first discharging action, the controller 60 allows the first head 20*a* to discharge the first liquids therefrom to the first gap area A1, without allowing the second head 20*b* to discharge the second liquids therefrom to the second gap area A2. Accordingly, the illuminance of the light in the first gap area. A1 arrives at the liquid curing illuminance I0 in the first curing time. The liquids in the first gap area A1 are cured.

The first scanning and the second scanning are executed between the conveyance action and another conveyance action which follows the conveyance action. In this procedure, the second liquid, which has the viscosity higher than that of the first liquid, has the discharging timing which comes later than the first liquid. On this account, the liquid curing time in the second gap area A2 can coincide with or approach the liquid curing time in the first gap area A1. As a result, it is possible to reduce the nonuniformity of the appearance of the cured matter of the liquid, and it is possible to suppress the deterioration of the printing image quality which would be otherwise caused by the shape of the printing medium A.

Other Modified Embodiments

In all of the embodiments and the modified embodiments described above, the relative movement device 40 moves the head 20 with respect to the printing medium A without moving the printing medium A in the left-right direction. On the contrary, the relative movement device 40 may move the stage 51 so that the printing medium A is moved with respect to the head 20 without moving the head 20 in the left-right direction.

For example, when the relative movement device 40 moves the stage 51, the relative movement device 40 may include the conveying device 50. In this case, the carriage 42 carries the stage 51, and the stage support stand 53 supports the movement rails 41. Accordingly, the stage 51 is movable in the left-right direction along the movement rails 41, and the movement rails 41 are movable in the front-rear direction. Therefore, the stage 51 is movable in the left-right direction and the front-rear direction with respect to the head unit 11.

In all of the embodiments and the modified embodiments described above, a lens may be arranged between the light irradiation unit 30 and the printing medium A. The light irradiation range of the light coming from the light irradiation unit 30 is narrowed by the lens. The difference arises between the light irradiation range provided when the lens is not arranged and the light irradiation range provided when the lens is arranged. The larger the gap between the light irradiation unit 30 and the printing medium A is, the larger the difference is. Accordingly, the difference in the light irradiation range, which would be otherwise caused by the difference in the gap, can be decreased. Thus, it is possible to decrease the difference in the curing time of the liquid on the printing medium A which would be otherwise caused by the light, it is possible to reduce the nonuniformity of the appearance of the cured matter of the liquid, and it is possible to suppress the deterioration of the printing image quality which would be otherwise caused by the shape of the printing medium A.

In the fourth embodiment and the sixth to eighth modified embodiments described above, for example, if the printing medium A is inclined in the left-right direction, the controller 60 may control the relative movement device 40 so that the larger the gap of the light irradiation unit 30 with respect to the printing medium A is, the more continuously delayed the relative movement speed between the printing medium A and the light irradiation unit 30 is.

In the fifth and sixth embodiments and the ninth to eleventh modified embodiments described above, the liquids having the different viscosities are used case by case depending on the gap. In place of the viscosities, the liquids, for which the illuminance for causing the temporary curing differs, may be used case by case depending on the gap. The illuminance, at which the liquid is temporarily cured, is adjusted by the content by percentage or the type of at least any one of the polymerization initiator for synthesizing the polymer contained in the liquid by means of the polymerization reaction and the molecule subjected to the polymerization.

For example, the first liquid may be discharged to the first gap area, and the second liquid, which has the temporary curing illuminance higher than that for the first liquid, may be discharged to the second gap area having the gap smaller than that of the first gap area. Accordingly, the curing time of the second liquid in the second gap area can coincide with or approach the curing time of the first liquid in the first gap area. As a result, it is possible to reduce the nonuniformity of the appearance of the cured matter of each of the liquids, and it is possible to suppress the deterioration of the printing image quality which would be otherwise caused by the shape of the printing medium A.

Note that all of the embodiments described above may be combined with each other unless one mutually exclude the other. Further, according to the foregoing explanation, it is clear for those skilled in the art to make many improvements and other embodiments of the present teaching. Therefore, the foregoing explanation should be interpreted as only exemplification, and the foregoing explanation is provided in order to teach the best mode for carrying out the present teaching to those skilled in the art. Details of the structure and/or the function of the present teaching can be substantially changed without deviating from the spirit of the present teaching.

What is claimed is:

1. A printing apparatus comprising:

a head configured to discharge liquid onto a printing medium; and a light irradiation unit aligned with the head in a first direction and configured to irradiate the liquid on the printing medium with light, wherein the light irradiation unit has a plurality of light source arrays arranged in the first direction, each of the light source arrays includes a plurality of light sources aligned in a second direction intersecting with the first direction, the light source arrays include a first light source array disposed most closely to the head in the first direction, and the light, which is radiated by each of the light sources included in the first light source array, has an intensity that is smaller than an intensity of the light which is radiated by each of the light sources included in the light source arrays different from the first light source array.

2. The printing apparatus according to claim 1, wherein each of the light sources included in the first light source array has a light-emitting element which radiates the light having the intensity smaller than the intensity of the light radiated by each of the light sources included in the light source arrays different from the first light source array.

3. The printing apparatus according to claim 1, further comprising a controller, wherein in a case that a gap between the light irradiation unit and the printing medium is a first gap, the controller is configured to decrease the intensity of the light of each of the light sources included in the first light source array as compared with a case that the gap is a second gap which is smaller than the first gap.

4. The printing apparatus according to claim 1, further comprising a controller, wherein the controller is configured to:

turn OFF the light sources included in the first light source array, in a case that a gap between the light irradiation unit and the printing medium is a first gap; and turn ON the light sources included in the first light source array, in a case that the gap is a second gap which is smaller than the first gap.

5. The printing apparatus according to claim 1, wherein the light source arrays further include a second light source array, the second light source array is arranged farther in the first direction from the first light source array than a center of the light source arrays in the first direction, and the intensity of the light radiated by each of the light sources included in the second light source array is larger than the intensity of the light radiated by each of the light sources included in the light source arrays different from the second light source array.

6. The printing apparatus according to claim 5, further comprising a controller, wherein in a case that a gap between the light irradiation unit and the printing medium is a first gap, the controller is configured to increase the intensity of the light radiated by each of the light sources included in the second light source array as compared with a case that the gap is a second gap which is smaller than the first gap.

7. A printing apparatus comprising:

a head configured to discharge liquid onto a printing medium;

a light irradiation unit aligned with the head in a first direction and configured to irradiate the liquid on the printing medium with light; and a controller, wherein the light irradiation unit has a plurality of light source arrays arranged in the first direction, each of the light source arrays includes a plurality of light sources aligned in a second direction intersecting with the first direction, the light source arrays include a proximity light source array disposed most closely to the head in the first direction, each of the light sources included in the proximity light source array is arranged to radiate the light having an optical axis, the optical axis extending to approach the head in the first direction as the optical axis proceeds from the light source in a third direction which intersects with the first direction and the second direction, and the controller is configured to:

turn OFF the light sources included in the proximity light source array in a case that a gap between the light irradiation unit and the printing medium is a first gap; and turn ON the light sources included in the proximity light source array in a case that the gap is a second gap which is smaller than the first gap.

8. A printing apparatus comprising:

a head configured to discharge liquid onto a printing medium;

a relative movement device configured to relatively move the printing medium and the head in a relative movement direction;

a light irradiation unit including a first light irradiation unit having a light source for irradiating the liquid on the printing medium with light, and a second light irradiation unit which is arranged nearer to the head than the first light irradiation unit in the relative movement direction and which has a light source for irradiating the liquid on the printing medium with light; and a controller, wherein the controller is configured to:

turn ON the first light irradiation unit and turn OFF the second light irradiation unit, in a case that a gap between the light irradiation unit and the printing medium is a first gap; and turn ON the second light irradiation unit is and turn OFF the first light irradiation unit, in a case that the gap is a second gap which is smaller than the first gap.

9. The printing apparatus according to claim 8, wherein the relative movement device further includes a carriage configured to carry the head, the first light irradiation unit, and the second light irradiation unit, the carriage being movable in the relative movement direction, the first light irradiation unit and the second light irradiation unit are arranged to sandwich the head in the relative movement direction, and the controller is configured to:

allow the head to discharge the liquid therefrom and allow the first light irradiation unit to radiate the light therefrom, while moving the carriage in a direction in which the second light irradiation unit precedes the head, in the case that the gap is the first gap; and allow the head to discharge the liquid therefrom and allow the second light irradiation unit to radiate the light therefrom, while moving the carriage in a direction in which the first light irradiation unit precedes the head, in the case that the gap is the second gap.

* * * * *